US007165370B1

(12) United States Patent
Wolfe

(10) Patent No.: US 7,165,370 B1
(45) Date of Patent: Jan. 23, 2007

(54) METHOD OF TRANSPORT

(76) Inventor: Michael J. Wolfe, 2408 Navarez Ave., Safety Harbor, FL (US) 34695

( * ) Notice: Subject to any disclaimer, the term of this patent is extended or adjusted under 35 U.S.C. 154(b) by 0 days.

(21) Appl. No.: 11/127,608

(22) Filed: May 12, 2005

Related U.S. Application Data

(62) Division of application No. 10/677,773, filed on Oct. 2, 2003, now Pat. No. 7,021,014.

(51) Int. Cl.
*E04B 2/08* (2006.01)

(52) U.S. Cl. ..... 52/589.1; 52/122.1; 52/125.2; 52/143

(58) Field of Classification Search ..... 52/589.1, 52/122.1, 125.2, 125.3, 125.4, 143, 270
See application file for complete search history.

(56) References Cited

U.S. PATENT DOCUMENTS 2,039,183 A * 4/1936 Nagel ..... 52/602
3,944,242 A * 3/1976 Eubank ..... 280/30
4,200,305 A * 4/1980 Eubank ..... 280/404
4,545,169 A * 10/1985 Rizk ..... 52/601
6,101,779 A * 8/2000 Davenport ..... 52/602
7,021,014 B1 * 4/2006 Wolfe ..... 52/270

* cited by examiner

*Primary Examiner*—Basil Katcheves
(74) *Attorney, Agent, or Firm*—Edward P. Dutkiewicz

(57) ABSTRACT

A manufactured building system has a pair of pre-stressed multi-stemmed concrete floors. The pre-stressed multi-stemmed concrete floors are adapted to contact each other on one parallel side edge to form peripheral edges and a central joining edge. A part of a building is coupled to a pre-stressed multi-stemmed concrete floor. Also described is a Method of Transporting the pre-stressed multi-stemmed concrete floors with the partial building coupled there to, to a site. Also described is a Method of Manufacturing a pre-stressed multi-stemmed concrete floor.

4 Claims, 23 Drawing Sheets

FIG 2
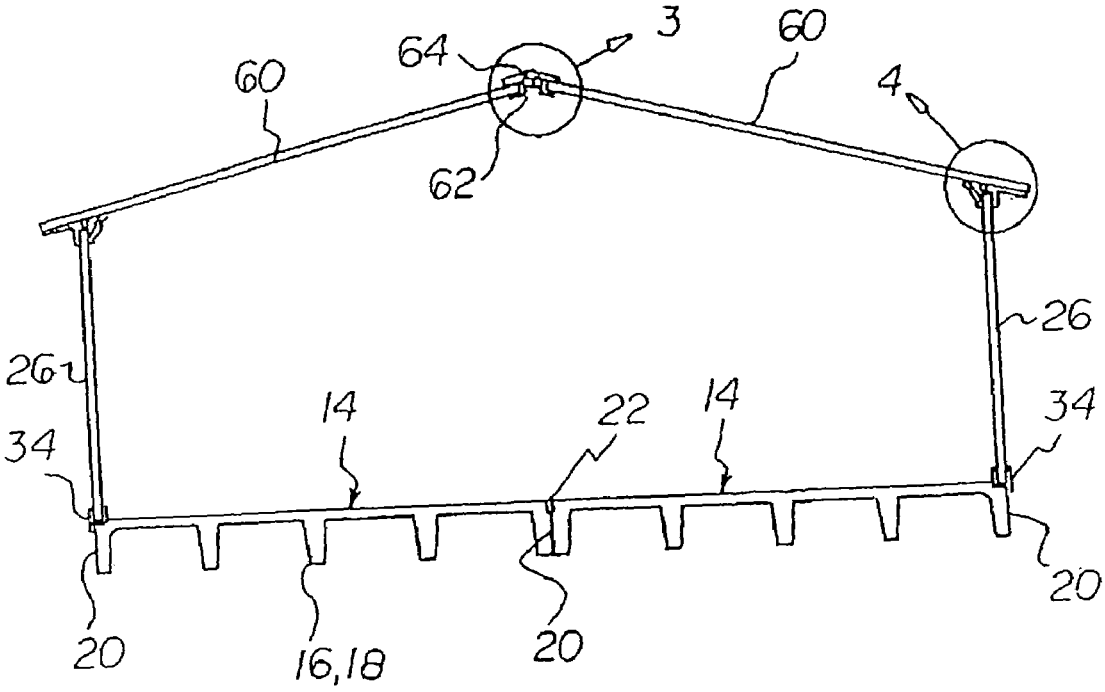
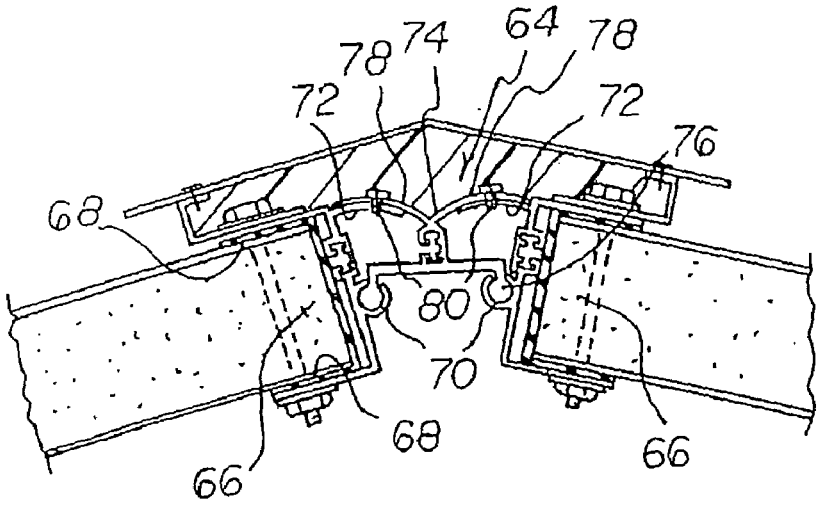
FIG 3

FIG. 6
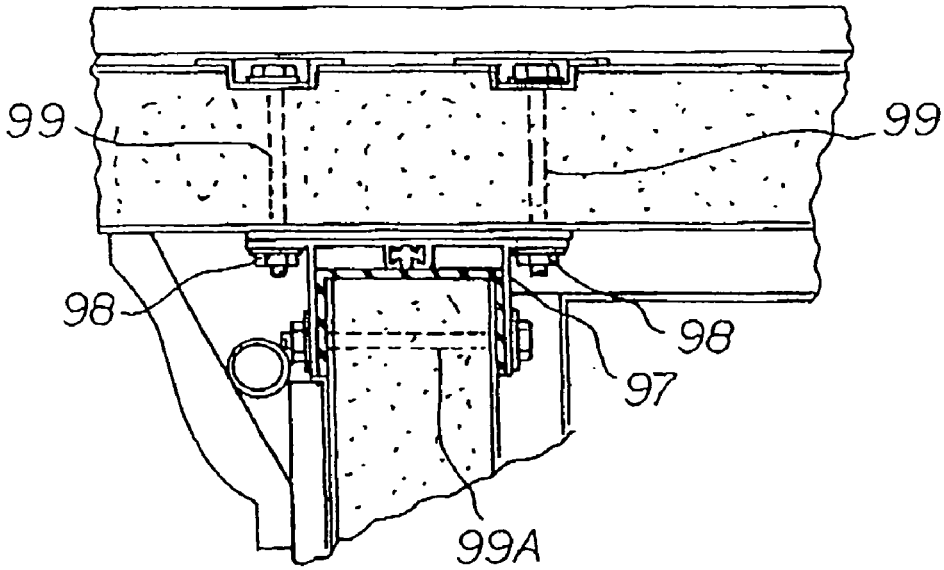
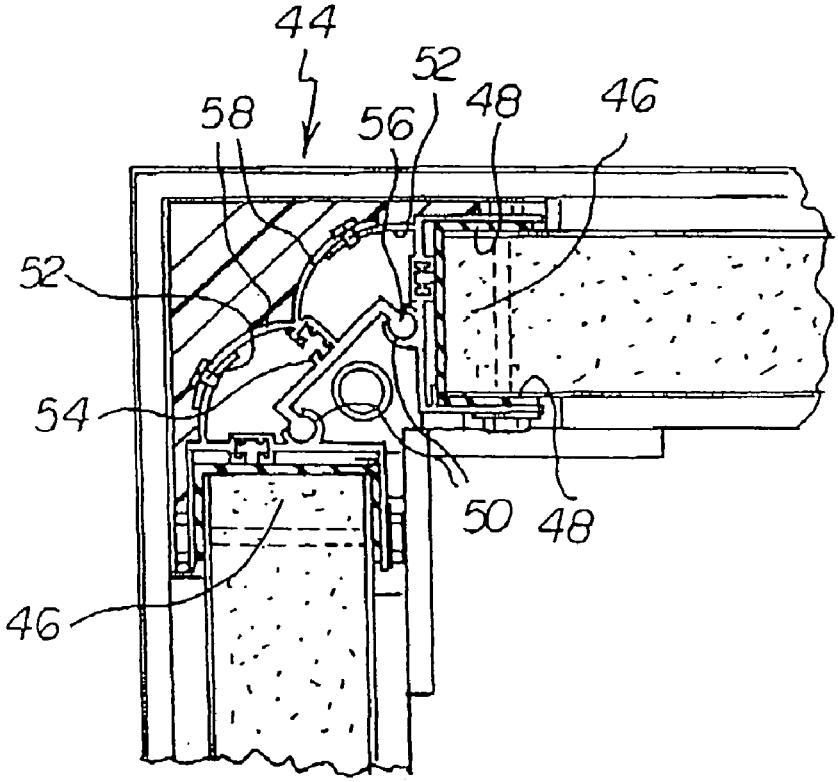
FIG 7

FIG 12
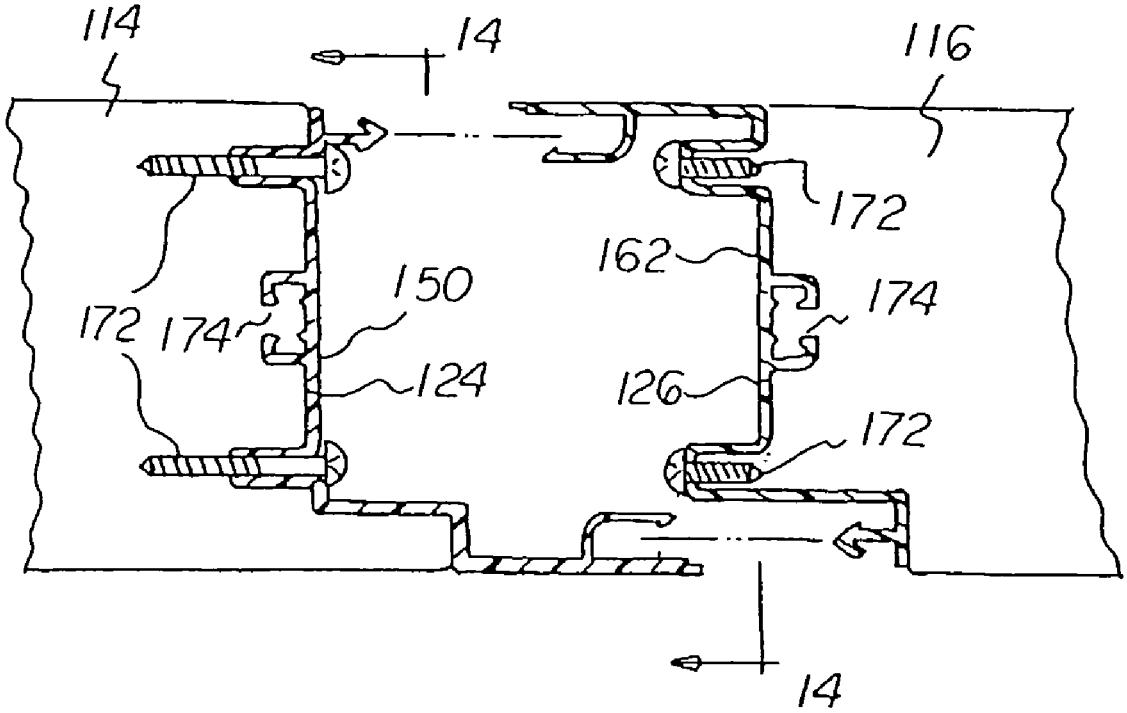
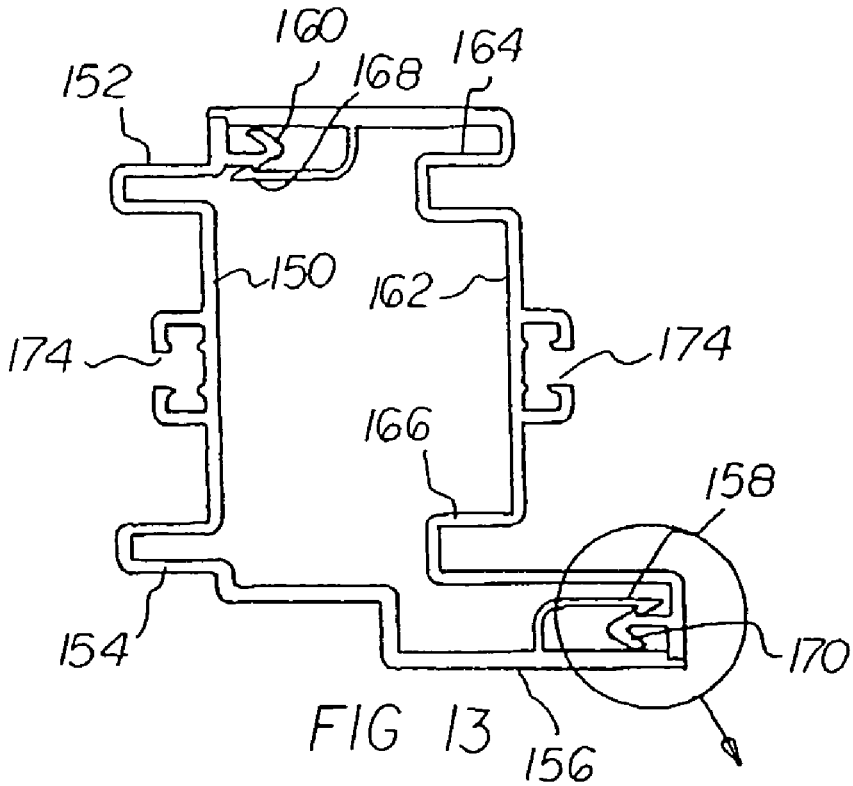
FIG 13

METHOD OF TRANSPORT

RELATED APPLICATION

The present application is a division of application U.S. Ser. No. 10/677,773 filed Oct. 2, 2003 now U.S. Pat. No. 7,021,014 entitled Manufactured Building System and Method of Manufacture and Method of Transport.

BACKGROUND OF THE INVENTION

1. Field of the Invention

The present invention relates to a manufactured building system and more particularly pertains to constructing partially prefabricated homes and school classrooms that can be easily transported and assembled.

2. Description of the Prior Art

Generally, the manufactured building systems available in today=s market incorporate designs and materials that have not been changed or improved for more than 30 years. Most transportable manufactured homes are built with conventional building materials such as wood stud frames, fiberglass batt insulation, wood siding, wood floors, wood roof trusses, asphalt roof shingles and a steel trailer frame with permanently attached wheels for transport from the factory to the building site. The weights of the materials used in the construction are relatively heavy when compared to the weight of the floor system or foundational materials resulting in a top-heavy structure with a high center of gravity. This is contrary to good engineering practice wherein it is known that a heavy foundation is needed to overcome the overturning, uplift and sliding forces exerted by high winds.

Because of the permanently attached wheels and steel trailer frame that also supports the wood floors, most manufactured buildings are erected on the building site by jacking the building up and placing concrete blocks under the trailer bed at specified locations. The building is then lowered onto the concrete block piers. The wheels remain attached to the steel trailer bed. This erection method results in a building that has the floor system elevated two to three feet above the ground. The space around the bottom of the building is enclosed around the perimeter with fencing, blinds, skirts or other apparatus designed to hide the concrete block piers and steel trailer bed from view. This type of building system is commonly referred to as the "trailer look".

Because of the lightweight of the steel trailer bed, and other foundational elements, there is little resistance to high wind loads and the building can easily be blown off of the concrete piers during high winds. To prevent this problem, the manufacturers of this type of building system have devised an anchoring system that is intended to hold the building down to the concrete piers in order to resist overturning, uplift and sliding forces generated by high winds. The anchor system is comprised of steel rods that are driven into the ground to a specified depth and at specified intervals. Steel straps are then connected between the rods and the underside of the steel trailer bed and tensioned by means of a turnbuckle or other device that stretches the steel straps to exert a downward force on the building assembly. The manufacturers claim that this system is adequate to prevent uplift or overturning of their buildings during high winds and the applicable building codes are written to include tie-down straps as a condition precedent to the issuance of a certificate of occupancy.

Although the manufacturers claim that the tie down straps adequately withstand the wind loads, it is well known that conventional manufactured buildings are not safe for habitation during high windstorms. Although the tie down strap system offers some improvement in the structural strength of the building, it does not achieve the degree of structural strength that is needed to withstand hurricane force winds or that would be achieved with a floor system or foundation that is heavier than the structure above.

The wall construction of conventional manufactured buildings is generally comprised of wood studs with fiberglass batt insulation between the studs. The exterior side of the wall is generally covered with oriented strand board (OSB) and the interior side with gypsum board (drywall). The overall thickness of these walls is approximately 4 inches.

Because the walls are constructed with wood studs and are insulated with fiberglass insulation installed into a 4-inch thick cavity there are two resultant deficiencies. The most obvious deficiency is the highly flammable wood construction. These buildings burn very fast and are a fire hazard for the occupants. The second is the energy efficiency. Generally it is not possible to achieve an insulation or R-value greater than an R-11 with the 4-inch thick wall. These buildings are generally not very energy efficient.

Walls constructed with wooden materials are flexible and do not achieve the structural strength that can be achieved with other building materials such as steel, concrete or composite building panels. This places limits on the wind loads that a wood stud wall can withstand. In order to increase the strength of wood stud buildings to withstand the constantly increasing building codes it is necessary to include more studs spaced closer together in the wall. This increases the cost of construction and consumes more of our precious natural resource.

The roof system of conventional manufactured buildings is generally constructed with a wooden truss system. A wooden truss is a generally triangular shape with a bottom part that is flat and is connected from one side of the building to the opposite side of the building parallel with the floor. The two sloping halves of the roof are connected at the outermost side of the bottom part and slope upward to the connection at the roof ridge to form a triangle. Since the outside of the roof truss is covered with roofing materials such as plywood and shingles and the inside of the roof truss is covered with drywall, a cavity is created on the interior sides of the roof truss.

There are three problems inherent in this design. The first problem is with the excessive amount of heat that is known to build up inside the cavity. The open space inside the truss serves as a container that captures heat similar to an oven. This requires the building designers to incorporate a means to ventilate the heat to the building exterior. Although some heat can escape to the outside of the building through attic vents, most of the heat remains inside the roof truss cavity and escapes to the buildings interior. This places an excessive load on the air conditioning system and is not an energy efficient design.

The second problem is with the uplift forces exerted on a roof truss system during windstorms. It is well known that roof systems that are not made an integral and structural part of the overall building envelope can be blown off and separated from the building during high winds. Therefore the building manufacturers must incorporate a means to adequately tie the truss system to the outside walls of the building with straps or other means of mechanically fastening the truss system to the building walls. This is generally accomplished with tie down straps or truss brackets.

Although these devices offer some resistance to uplift forces, it is generally known that this remains a weak part of the overall structure.

The third problem is that most roof trusses are constructed with wooden materials. As with the exterior walls this creates a fire hazard.

Roof trusses constructed with wooden materials are flexible and do not achieve the structural strength that can be achieved with other building materials such as steel, concrete or composite building panels. This places limits on the wind loads that a roof truss can withstand. In order to increase the strength of roofs constructed with wooden trusses to withstand more stringent and constantly increasing building codes, it is necessary to include more trusses spaced closer together. This increases the cost of construction and consumes more of our precious natural resource.

The floor systems of conventional manufactured buildings are generally constructed with wooden floor joists that are supported underneath with a steel trailer body constructed with steel channels and angles. The wooden joists are covered on the topside with oriented strand board or plywood panels. This floor system is relatively lightweight and does not achieve the structural strength that is found with a concrete floor.

A wooden floor system is relatively flexible and cannot support the weight of heavy objects such as refrigerators, dressers and other interior furnishings. Over time, these floor systems have a tendency to warp or bow from the furniture and other dead and live loads placed upon them.

A wooden floor system can burn easily and rapidly. This creates a fire hazard for the building occupants.

It can be thus appreciated that the use of manufactured building systems of known designs and configurations is known in the prior art. More specifically, manufactured building systems of known designs and configurations previously devised and utilized for the purpose of constructing buildings by known methods and apparatuses are known to consist basically of familiar, expected, and obvious structural configurations and building materials, notwithstanding the myriad of designs encompassed by the crowded prior art which has been developed for the fulfillment of countless objectives and requirements.

By way of example, U.S. Pat. No. 5,373,678 to Hesser issued Dec. 10, 1994, relates to a structural insulated building panel. Hesser teaches a building panel that incorporates an internal stiffener stud that can be formed through the manufacturing process simultaneously with the exterior steel skins and polyurethane foam core. Hesser further teaches a means of connecting the building panels together with hand formed metal sheets and screws to form the walls and roofs for various buildings. There are limitations with this design because the hand made bent metal shapes cannot me made in long lengths and are not structurally strong. They cannot be made with in integral thermal break and a multitude of screws are required to connect the metal shapes to the thin skin of the building panel. The assembly design depicted in the Hesser patent is labor intensive, which results in excessive cost for material fabrication and erection. The Hesser design is not structurally strong because the metal shape itself does not control the positive and negative wind loads exerted on a building. The loads are exerted fully on the multitude of screws connecting the metal shape to the panel. Hesser does not teach an extruded aluminum connector system that can be manufactured in long lengths. Hesser does not teach an extruded aluminum connector system that includes an integral thermal break and that is adjustable to accommodate various roof pitches and vertical wall angles. Hesser does not teach an extruded aluminum connector system that is connected to the building panels with through bolts or that control the positive and negative wind loads through the connector itself. Hesser does not teach a manufactured building system that can be transported on a self-trailering multi-stemmed concrete floor system.

U.S. Pat. No. 5,509,242 to Rechsteiner issued Apr. 23, 1996, relates to a structural insulated building panel system. Rechsteiner teaches a building panel that is reinforced by inserting steel angles, by hand, into the open edge after the panel is manufactured. This method of reinforcing a building panel is costly, due to higher material costs, and labor intensive, due to inserting the pieces by hand. Rechsteiner further teaches a method of connecting the panels together with the same hand made bent metal shapes taught in Hesser. In fact the only difference between Hesser and Rechsteiner is the method of reinforcing the building panel. Rechsteiner has the same limitations with the assembly of the building panels as described above in Hesser.

U.S. Pat. No. 6,101,779 issued on Aug. 15, 2000 to Davenport teaches a pre-cast concrete slab having a multi-bayed construction. The concrete slab depicted here relies on a multitude of beams, purlins and ribs to form a supporting structure that are reinforced with deformed reinforcing bar steel (rebar). The concrete slab depicted here is formed by laying a multitude of steel channels in different directions to provide a trough for forming the concrete. Many Styrofoam blocks are laid out between the steel channels to provide additional forming members for the concrete. In order to provide longitudinal support sufficient to hold the concrete together and avoid cracking during transport, a considerable amount of steel rebar and wire mesh is laid out on top of the steel channels and Styrofoam forms. The method of constructing the pre-cast concrete slab depicted in Davenport uses an excessive amount of steel that is all placed by hand. This results in excessive material and labor costs. In fact, the concrete slab taught by Davenport is really the same steel support frame used in the manufactured building segment for the past 30 years but with concrete poured on the top. Furthermore, the steel bottom channels are exposed which makes the support frame susceptible to rust and corrosion.

For transport, the Davenport concrete slab must be lifted and placed on a steel trailer or bogey with wheels located at the front and rear of the unit. The wheels are not able to be located partially within the open spaces under the slab because of the multitude of cross beams, purlins and ribs formed to provide lateral support of the concrete. This causes the slab to be located above the height of the wheels and steel forming the trailer or bogey frame thereby increasing the space between the bottom of the slab and the roadway during transport. This causes the center of gravity to be higher than is desirable and limits the overall building height for passing under bridges and utility lines.

Davenport does not teach a multi-stemmed concrete floor that is manufactured by the pre-stressing method. Davenport does not teach a multi-stemmed concrete floor that transfers all of the longitudinal live and dead loads to a reinforced diaphragm header. Davenport does not teach a multi-stemmed concrete floor that is manufactured entirely of concrete and does not rely an exposed steel frame for structural support. Davenport does not teach a multi-stemmed concrete floor that is transported by attaching a wheel assembly directly to the down turned stems. Davenport does not teach a multi-stemmed concrete floor that has wheels located on only the rear end. Davenport does not teach a multi-stemmed concrete floor that minimizes the clearance between the roadway and bottom side of the floor by concealing the upper ⅓ of the wheel within the open spaces between the down turned stems. Davenport does not teach a multi-stemmed concrete floor that is manufactured in a self-stressing steel form with a removable stressing block.

U.S. Pat. No. 3,944,242 issued on Mar. 16, 1976 to Eubank addresses the center of gravity problems inherent to a movable building, such as a prefabricated house and with the deficiencies inherent with pre-cast slabs as taught in Davenport. Eubanks teaches a concrete slab wherein the structural reinforcement of the concrete is made by the post-tensioning method, which is preferred to pre-casting. Although Eubanks refers to pre-stressing, a method of pre-stressing is not demonstrated by Eubanks. Eubanks teaches a concrete slab that is reinforced by post-tensioning in both the longitudinal and lateral directions. Without the lateral tensioning the Eubanks slab would easily break apart during transport. The forming bed depicted by Eubanks shows a form that has the two long side and two short side blocks forming the outer edge of the slab connected to a multitude of hydraulic rams. This allows the sides to by pulled away from the slab edges after the concrete has been poured and cured. It is necessary to make the sides removable in order to have access for the insertion and tensioning of the internal tensioning rods in both the longitudinal and lateral directions. The casting form depicted by Eubanks cannot be used to make a pre-stressed slab because the sides would collapse from the stress imposed by the stressing strands used in the pre-stressing method. Also, the tensioning of the slab after it has been cast and while it is still in the form would cause the inside face of the outermost side and end stems to be tightly compressed against the form thereby causing the slab to bind against the form and making it impossible to remove. This is why the Eubanks design never became commercially viable.

The method of transport depicted in FIG. 5 of Eubanks requires the use of a large and very heavy steel support frame to connect the multitude of wheels and axles depicted here. The method of transport depicted in FIG. 4 of Eubanks shows a wheel assembly connected to the outermost longitudinal stem with one wheel on the inside and one wheel on the outside. The outside wheel causes the overall width of the unit to be increased by approximately 12" on each side. This is not desirable because the overall width of the slab that can be transported over the highway is limited by the DOT regulations for maximum allowable widths. This results in a slab that is two feet less than what may be required.

Eubanks does not teach a multi-stemmed concrete floor that has several longitudinal stems running in a parallel direction. Eubanks does not teach a multi-stemmed concrete floor with a reinforced diaphragm header. Eubanks does not teach a multi-stemmed concrete floor that is reinforced by pre-stressing in only the longitudinal direction. Eubanks does not teach a multi-stemmed concrete floor that does not require post-tensioning or pre-stressing in the lateral direction and that is entirely reinforced in the lateral direction through the reinforced diaphragm header. Eubanks does not teach a pre-stressed concrete floor. Eubanks does not teach a multi-stemmed pre-stressed concrete floor that is manufactured in a self-stressing steel form. Eubanks does not teach a multi-stemmed concrete floor that is manufactured in a steel form with permanently fixed long sides and a removable stressing block. Eubanks does not teach a multi-stemmed concrete floor casting form that relieves the compressive forces exerted on the casting form with a compressible filler assembly. Eubanks does not teach a multi-stemmed concrete floor that is transported by attaching a wheel assembly directly to the interior longitudinal stem with the wheels inside the outer extents of the floor thereby allowing the concrete floor to be manufactured to the maximum width that can be safely transported over the highway.

As can be seen with the cited patents, some attempts have been made to overcome the inherent problems and deficiencies found with conventional manufactured homes and school classrooms but none has solved the aforementioned deficiencies. Reference is made to U.S. Pat. No. 5,373,678 to Hesser, U.S. Pat. No. 5,509,242 issued to Rechsteiner, U.S. Pat. No. 6,101,779 issued to Davenport, U.S. Pat. No. 3,944,242 issued to Eubanks, etc.

While these devices fulfill their respective, particular objectives and requirements, the aforementioned patents do not describe a manufactured building system that allows constructing partially prefabricated homes and school classrooms that can be easily assembled and constructed with a structural aluminum connector system and transported on a multi-stemmed pre-stressed concrete floor system.

In this respect, the manufactured building system according to the present invention substantially departs from the conventional concepts and designs of the prior art, and in doing so provides an apparatus primarily developed for the purpose of constructing partially prefabricated homes and school classrooms that can be easily transported and assembled and solves all of the problem inherent in the prior art.

It should be noted that the present invention utilizes the pre-stressing method of strengthening concrete. Pre-stressing greatly strengthens and improves the ability of the concrete material to withstand cracking during transport by putting the fully cured concrete element under compression. It is well known that concrete is strong in compression but weak in tension. The pre-stressing method of reinforcing concrete is also well known and has been utilized to manufacture double T bridge slabs, tilt-up wall slabs, roof slabs, building pilings and other such elements for many years. Therefore, the pre-stressing method itself is not being claimed herein as new art or part of this invention.

What is being claimed and made a part of this new invention is the application and use of the pre-stressing method in a new and innovative way. The prior art of reinforcing concrete elements by the pre-stressing method has been applied principally to the manufacture of double-stemmed concrete slabs for bridge and tilt-wall building construction. These slabs are manufactured in long lengths up to 60 feet long and short widths up to eleven feet wide. The two down turned stems are spaced approximately five feet apart and are manufactured from 12" to 36" high by 4" to 8" wide and are joined together across the top surface or web with a concrete flange that is 2" to 4" thick. They are open on the short ends with the cross sectional design clearly visible.

Because the relatively thin 2" to 4" thick flange is the only material connecting the two stems together, the slab must be moved out of the casting form by placing lifting loops at each end of the stems for a total of four lifting points. Great care must be taken to lift the stems in a parallel orientation to one another without bending or twisting which would cause the thin flange to break or crack. The thin 2" to 4" thick flange is incapable of supporting the weight of additional stems. During transport from the manufacturing plant to the erection location, the stems must be supported at equal heights and parallel to one another at each of the four ends. Furthermore, the relatively wide space between the stems requires the height of the stems to be relatively high in order to provide the structural strength needed to manufacture long lengths.

The present invention solves the problem of cracking or breaking the weak 2" to 4" flange by casting a reinforced diaphragm header integrally with multiple down turned stems. The diaphragm header conceals the cross sectional design from view and creates a closed end. Multiple down turned stems can be connected to the diaphragm header and eliminate the bending and twisting forces that are exerted on the flange in the double stem design. This enables the entire multi-stemmed concrete element to be lifted from the same four points as in the concrete element to be lifted from the same four points as in the double stem design but without cracking or breaking the flange because the diaphragm header supports the weight of all of the stems. The stems can also be placed closer together to allow a reduction in the overall height. All of the manufacturing problems caused by the compressive forces exerted by the pre-stressing method and resulting in shrinkage of the finished element have been overcome by the present invention and will be clearly explained by the diagrams, descriptions and claims made herein.

Therefore, it can be appreciated that there exists a continuing need for a new and improved manufactured building system, which can be used for constructing partially prefabricated homes and school classrooms that can be easily transported and assembled. The present invention can withstand hurricane force winds and is highly energy efficient as well as being insect and fire proof. The present invention further has a concrete floor and can withstand impact from large flying missiles. In this regard, the present invention substantially fulfills this need.

SUMMARY OF THE INVENTION

In view of the foregoing disadvantages inherent in the known types of building systems of known designs and configurations now present in the prior art, the present invention provides an improved manufactured building system. As such, the general purpose of the present invention, which will be described subsequently in greater detail, is to provide a new and improved manufactured building system and method, which has all the advantages of the prior art and none of the disadvantages.

To attain this, the present invention essentially comprises a pair of multi-stemmed pre-stressed concrete floor systems. Each pre-stressed concrete system has a generally rectangular configuration with a short front edge and parallel rear edge. Each multi-stemmed pre-stressed concrete floor system also has a pair of long parallel side edges between the front edge and rear edge. The multi-stemmed pre-stressed concrete floor systems are adapted to contact each other on one parallel side edge to form peripheral edges and a central joining edge. A plurality of vertically disposed structural composite wall panels are provided. The wall composite panels are associated with the peripheral edges. The wall panels extend upwardly from both the front and rear edges and the side edges remote from the central joining edge when the two floor systems are adjacent to each other. In this manner a closed space is defined. The wall panels also have window openings and door openings. Next provided is a plurality of base connectors positioned at the lower edges of the wall panels. Note FIG. 8. Each base connector has a first end with generally U-shaped flat faces receiving the wall panels adjacent to their lower edges. Each base connector also has a second end with components fix-ably positioned with respect to a base slab. Four adjustable corner connectors are provided. Note FIG. 7. The four corner connectors are coupled to adjacent vertical edges of the wall panels above the corners of the floor systems. Each corner connector is constructed of a fixed first component having U-shaped flat faces secured to the adjacent vertical edges of the wall panels. Each first component has a central cylindrical recess and an exterior arcuate first plate. Each corner connector also has an intermediate second component in a generally H-shaped configuration. The intermediate second component has interior cylinders rotatably received within the cylindrical recesses and with arcuate second plates in sliding contact with the first plates. Bolts fix-ably couple the arcuate plates at a predetermined angular orientation. Next provided are a pair of roof diaphragms constructed with composite building panels. Each roof diaphragm has a periphery there around. The roof diaphragms are intermediately angled with respect to each other to form a linear ridge at the top parallel with and above the central joining edge of the slabs when the two roof diaphragms are laterally aligned. An adjustable roof ridge connector is provided. Note FIG. 3. The roof ridge connector is constructed of fixed first components having U-shaped flat faces secured to the adjacent edges of the roof diaphragms. Each first component has a central cylindrical recess and an exterior arcuate first plate. Each roof ridge connector also has an intermediate second component in a generally H-shaped configuration. The intermediate second component has interior cylinders rotatably received within a cylindrical recess. The intermediate second component also has arcuate second plates in sliding contact with the first plates. Bolts fix-ably couple the arcuate plates at a predetermined angular orientation. Next provided is a pair of adjustable eave connectors. The eave connectors are positioned between the upper edges of the wall panels and the inside of the roof diaphragms. Each eave connector has a first component. The first component has a flat face coupled to a roof panel with a central cylindrical component and an exterior first arcuate plate. Each eave connector also has a second component. The second component has a U-shaped flat face secured to the adjacent upper edge of the wall panels. The second component also has a central cylindrical recess and a second exterior arcuate plate in sliding contact with the first plate. Each adjustable eave connector has a bolt fix-ably coupling the arcuate plates at a predetermined angular orientation. A pair of gable end walls constructed with composite material is provided. The gable end walls have a periphery there around. The gable end walls are intermediately angled with respect to each other to form a linear ridge at the top when the two gable end walls are aligned. Next are provided gable end connectors coupled between the gable end walls and the roof diaphragm. Note FIG. 6. Each gable end connector is in a C-shaped configuration with oppositely extending apertured flanges running parallel with the C-shaped channels. Bolts pass through the roof diaphragms and flanges to fixably connect the roof diaphragm to the gable end connectors. Another bolt also extends through the C-shaped channel and the vertical gable end wall for fixable coupling there between. The panel system also includes a plurality of panels formed of elastomeric foam. Each panel is in a rectangular configuration. One side edge of each panel is in facing relationship with the other side edge of an adjacent panel. Each panel has one side edge formed with two vertically extending small parallel recesses and one vertically extending large edge projection. Each panel has the other side edge formed with two vertically extending small parallel projections and one vertically extending large edge recess. Also provided is a first plate formed with two vertically extending small parallel projections within the recesses of the one side edge and one vertically extending large edge projection. The first plate has at least one spear-shaped projection. A second plate is provided. The second plate is formed with two vertically extending small parallel projections positioned over the projections of the other side edge and one vertically extending large edge recess within the edge recess of the other side edge. The second plate has at least one small spear-shaped projection. The large spear-like projection of each plate is in coupling relationship with the small spear-like projection of each adjacent plate.

A multi-stemmed floor is used on conjunction with the above described building process. Also disclosed is a transportation means by which the floor system may be moved to a building site. Also disclosed is a method of making a multi-stemmed floor system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved manufactured building system, which may be built economically for sale in the affordable and/or low-income housing and school classroom market.

It is therefore a further object of the present invention to provide a new and improved manufactured building system, which may be factory, built under controlled conditions to assure quality control.

It is therefore another object of the present invention to provide a new and improved manufactured building system, which may withstand high wind loads in hurricane zones without the need to add external tie-down devices.

It is therefore another object of the present invention to provide a new and improved manufactured building system, which may withstand impact from large missiles in accordance with the new building codes for construction in hurricane zones.

It is therefore a further object of the present invention to provide a new and improved manufactured building system, which is completely fireproof.

It is therefore a further object of the present invention to provide a new and improved manufactured building system, which is completely termite and insect proof.

It is therefore a further object of the present invention to provide a new and improved manufactured building system, which is constructed with a lightweight but super-strong composite building panels.

It is therefore a further object of the present invention to provide a new and improved manufactured building system, which is highly energy efficient with a minimum R-24 rating in the exterior walls and roofs.

It is therefore a further object of the present invention to provide a new and improved manufactured building system that withstands the overturning, uplift and sliding movements exerted by hurricane force winds without the need for external tie-down devices as is required for conventional manufactured homes.

It is therefore a further object of the present invention to provide a new and improved manufactured building system that is completely open on the interior with cathedral ceilings throughout enabling the air conditioning or heating system to work within the entire building envelope thereby enhancing the overall energy efficiency.

It is therefore a further object of the present invention to provide a new and improved manufactured building system that is constructed with a new and innovative multi-stemmed concrete floor system that is reinforced by the pre-stressing method in the longitudinal direction.

It is therefore a further object of the present invention to provide a new and improved manufactured building system that is constructed with a new and innovative multi-stemmed concrete floor system that does not require pre-stressing or post-tensioning in the lateral direction but that has all of the lateral loads directed to and supported by a reinforced diaphragm header at both ends.

It is therefore a further object of the present invention to provide a new and improved manufactured building system that is self-trailing and does not need an additional Gurney, bogey, flat bed trailer or any other supporting structure to transport the finished building.

It is therefore a further object of the invention to provide a self-trailing concrete floor system that can be moved over the highway with a minimal road clearance of 16" to 18" in order to maximize the roof pitch and still be able to clear the overhead bridges, utility lines, etc.

It is therefore a further object of the invention to manufacture a concrete floor system that can be rolled by bolting lo-boy trailer tires and axles directly to the down turned concrete stems thereby eliminating the need to support the concrete floor system with a steel frame as is required in the prior art.

It is therefore a further object of the invention to manufacture a concrete floor system that can be pulled by attaching a fifth wheel towing device directly to the concrete stem thereby eliminating the need to place wheels, dollies, Gurney=s, bogey=s etc. on the front end.

It is therefore a further object of the invention to provide a concrete floor system that is designed to tie together and transfer all of the longitudinal loads imposed on the long parallel down turned stems to a reinforced diaphragm header beam so that a fully unitized and strong structure is achieved.

It is therefore a further object of the invention to provide a concrete floor system that can be placed directly on the ground on 3'×3' pads placed only on the outside corners with all of the longitudinal loads transferred through the reinforced diaphragm header beam to the corner pads.

It is therefore a further object of the present invention to provide a new and improved manufactured building system that is designed with the heavy elements of the structure at the bottom or in the foundation according to sound engineering principals.

It is therefore a further object of the present invention to provide a new and improved manufactured building system that is constructed with a patented structural aluminum connector system.

It is therefore a further object of the present invention to provide a new and improved manufactured building system that is constructed with building materials that do not deplete our precious and vanishing natural resources.

Lastly, it is an object of the present invention to provide a new and improved manufactured building system. The system has a pair of multi-stemmed pre-stressed concrete floor systems. Each multi-stemmed concrete floor system has a generally rectangular configuration with parallel front and rear edges and parallel side edges. The concrete floor systems are adapted to contact each other on one parallel side edge to form peripheral edges and a central joining edge. A plurality of vertically disposed wall panels are associated with the peripheral edges extending upwardly from the edges remote from the central joining edge when the two floor systems are adjacent. Base connectors are positioned at the lower edges of the wall panels. Four corner connectors are coupled to adjacent vertical edges of the wall panels above the corners of the floor systems. Roof diaphragms each have a periphery there around and are intermediately angled with respect to each other to form a linear ridge at the top parallel with and above the central joining edge of the slabs when the two roof diaphragms are laterally aligned. An adjustable roof ridge connector and eave connectors with rotational axles and arcuate locking flanges are incorporated to maintain the roof diaphragms at a predetermined angular orientation.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a cross-sectional view taken along line 2—2 of FIG. 1.

FIG. 3 is a cross-sectional view taken at circle 3 of FIG. 2 showing the roof ridge connector.

FIGS. 6 through 9 are cross-sectional views taken at intermediate points showing the various connectors including the gable end connector, corner connector, base connector and hip roof connector.

FIG. 12 is a cross-sectional view of the present invention similar to FIG. 11 with the plates separated.

FIG. 13 is an enlarged cross-sectional view of the present invention similar to FIG. 11 with the plates connected.

The same reference numerals refer to the same parts throughout the various Figures.

DESCRIPTION OF THE PREFERRED EMBODIMENT

Figure 1:
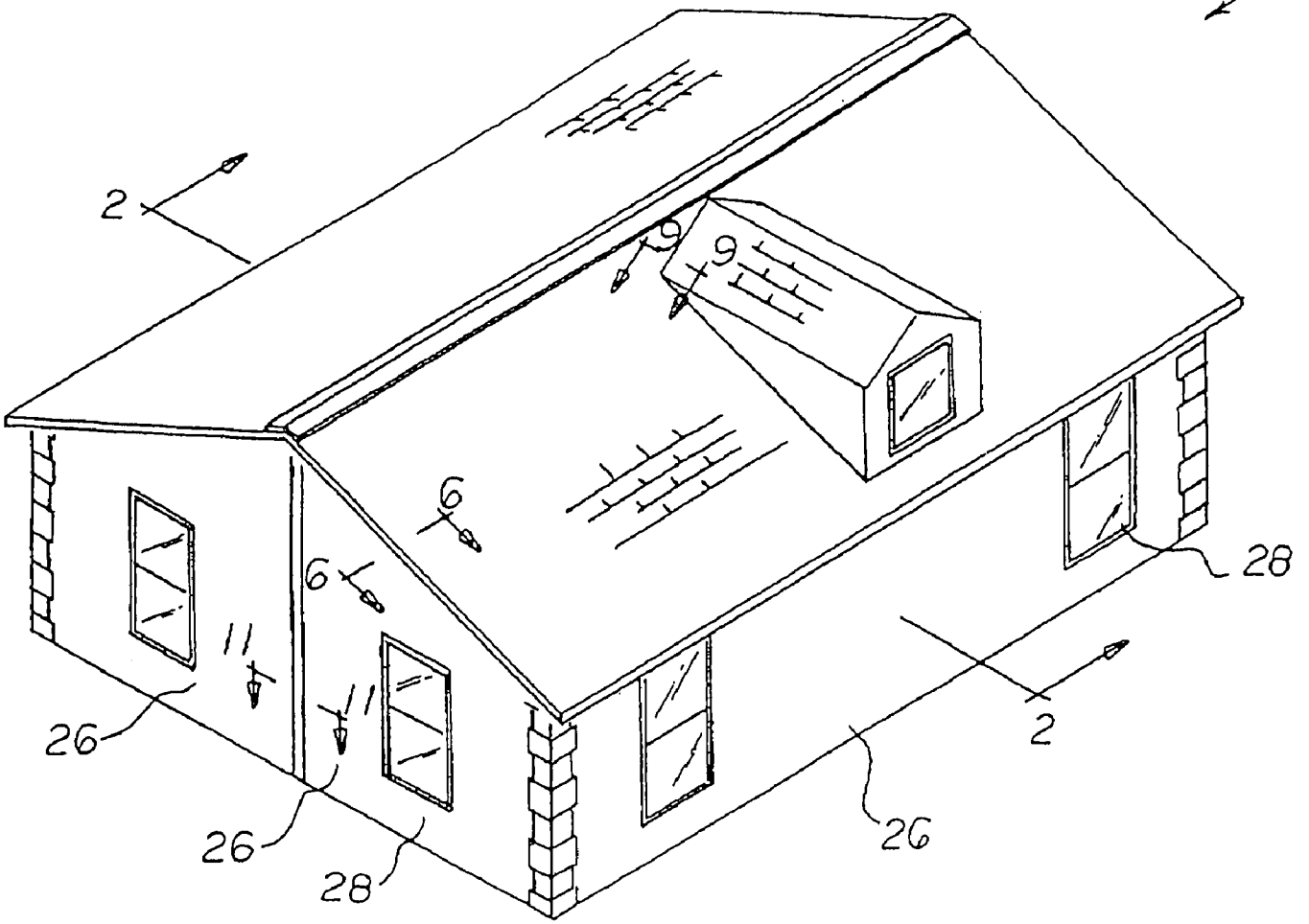
FIG. 1 is a perspective illustration of the manufactured building system constructed in accordance with the principles of the present invention.
Figure 4:
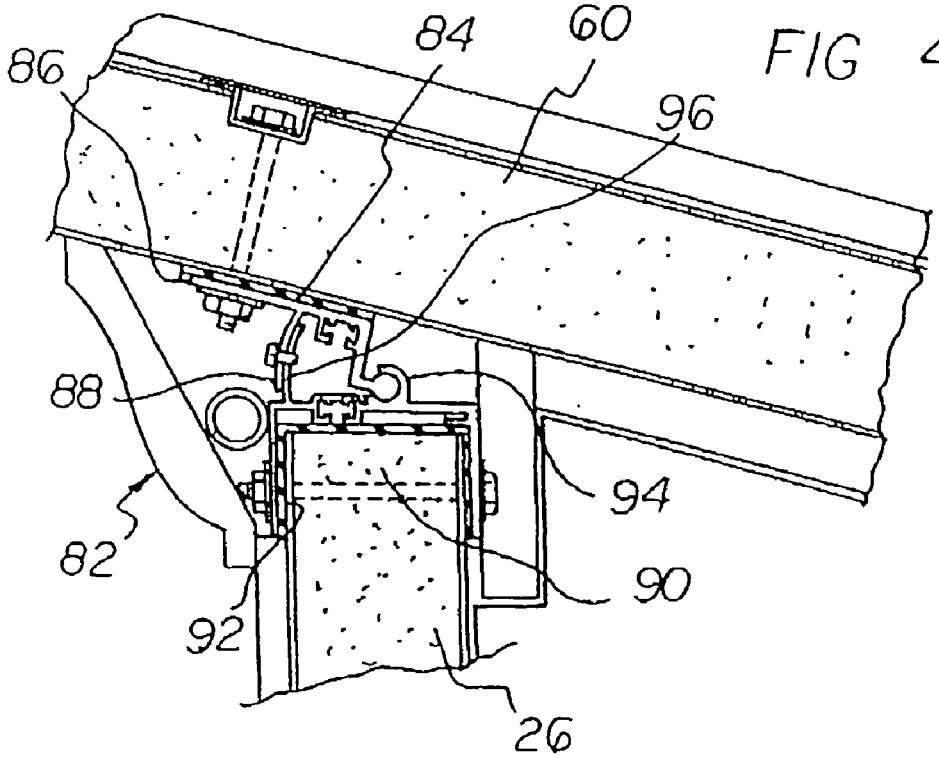
FIG. 4 is a cross-sectional view taken at circle 4 of FIG. 2 showing the connector between the roof and sidewall.
Figure 5:
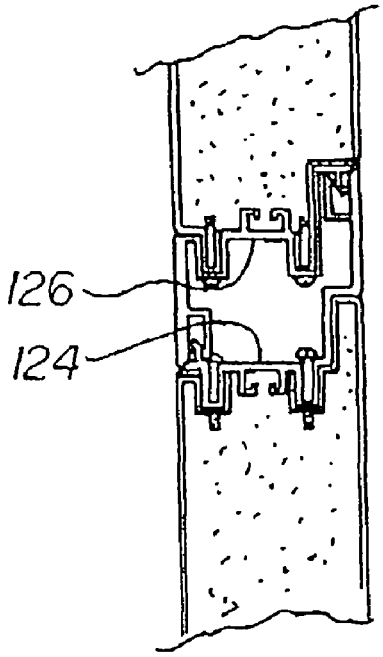
FIG. 5 is an enlarged showing of the self-mating edge adapter (SMEA).
Figure 8:
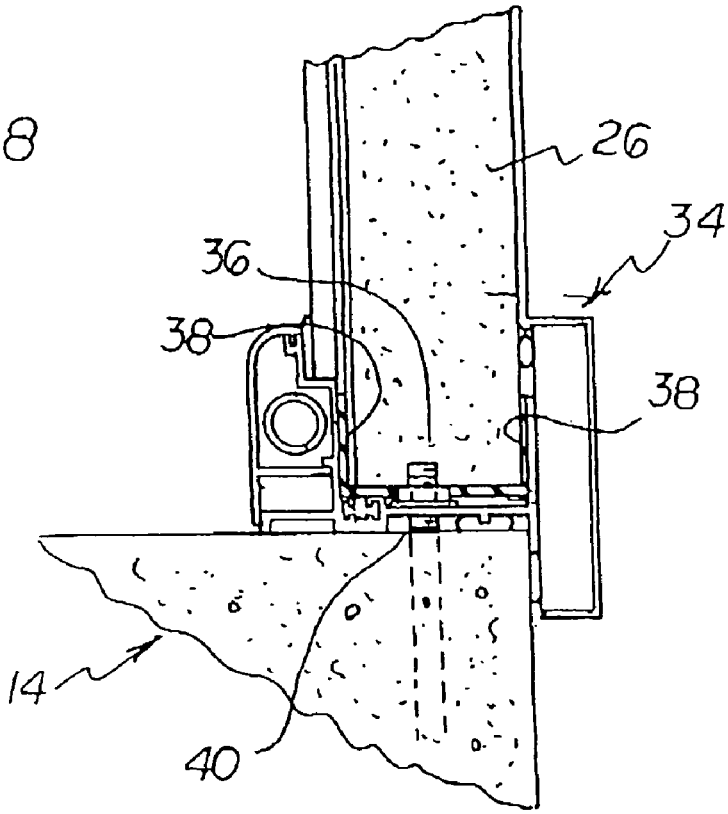
Figure 9:
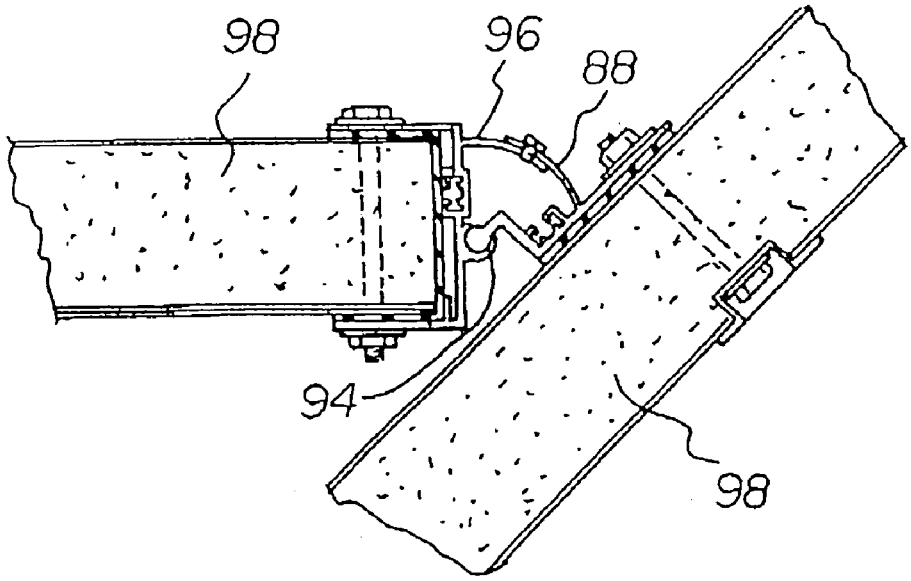
Figure 10:
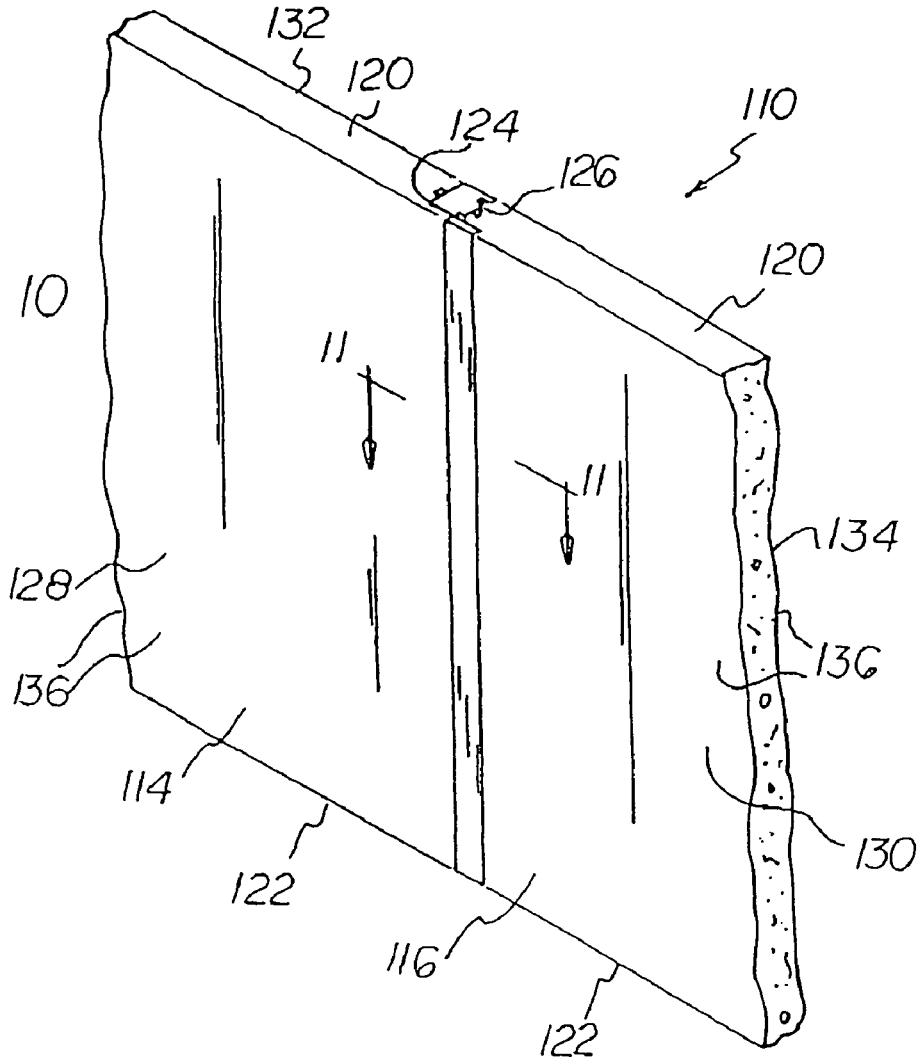
FIG. 10 is a perspective view of the preferred embodiment of the building system for coupling adjacent vertical edges of panels in a more safe, secure, economical and convenient manner.

With reference now to the drawings, and in particular to FIG. 1 thereof, the preferred embodiment of the new and improved manufactured building system embodying the principles and concepts of the present invention and generally designated by the reference numeral 10 will be described.

The present invention, the manufactured building system 10 is comprised of a plurality of components. Such components in their broadest context include a pair of multi-stemmed pre-stressed concrete floor systems, a plurality of vertically disposed structural composite wall panels and a connector system including base connectors, four corner connectors, adjustable eave connectors, roof diaphragms, an adjustable roof ridge connector, self-mating edge adapters and gable end connectors. Such components are individually configured and correlated with respect to each other so as to attain the desired objective.

The manufactured building system for constructing partially prefabricated homes that can be easily transported and assembled has a pair of multi-stemmed pre-stressed concrete floors 14. Each multi-stemmed floor has a generally rectangular configuration with a short front edge 16 and parallel rear edge 18. Each multi-stemmed floor also has a pair of long parallel side edges 20 between the front edge and rear edge. The multi-stemmed floors are adapted to contact each other on one parallel side edge to form peripheral edges and a central joining edge 22.

A plurality of vertically disposed wall panels 26 are provided. The wall panels are associated with the peripheral edges. The wall panels extend upwardly from both the front and rear edges and the side edges remote from the central joining edge when the two floor systems are adjacent to each other. In this manner a closed space is defined. The wall panels also have window openings 28 and door openings (not shown).

Next provided are a plurality of base connectors 34 positioned at the lower edges of the wall panels. Each base connector has a first end 36 with generally U-shaped flat faces 38 receiving the wall panels adjacent to their lower edges. Each base connector also has a second end 40 with components fix-ably positioned with respect to a base slab.

Four adjustable corner connectors 44 are provided. The four adjustable corner connectors are coupled to adjacent vertical edges of the wall panels above the corners of the floor systems. Each corner connector is constructed of a fixed first component 46 having U-shaped flat faces 48 secured to the adjacent vertical edges of the wall panels. Each first component has a central cylindrical recess 50 and an exterior arcuate first plate 52. Each corner connector also has an intermediate second component 54 in a generally H-shaped configuration. The intermediate second component has interior cylinders 56 rotatably received within the cylindrical recesses and with arcuate second plates 58 in sliding contact with the first plates. Bolts fix-ably couple the arcuate plates at a predetermined angular orientation.

Next provided are a pair of roof diaphragms 60 constructed with composite building panels. Each roof diaphragm has a periphery there around. The roof diaphragms are intermediately angled with respect to each other to form a linear ridge 62 at the top parallel with and above the central joining edge of the slabs when the two roof diaphragms are laterally aligned.

An adjustable roof ridge connector 64 is also provided. The roof ridge connector is constructed of fixed first components 66 having U-shaped flat faces 68 secured to the adjacent edges of the roof diaphragms. Each first component has a central cylindrical recess 70 and an exterior arcuate first plate 72. Each roof ridge connector also has an intermediate second component 74 in a generally H-shaped configuration. The intermediate second component has interior cylinders 76 rotatably received within a cylindrical recess. The intermediate second component also has arcuate second plates 78 in sliding contact with the first plates. Bolts 80 fixably couple the arcuate plates at a predetermined angular orientation.

Next provided is a pair of adjustable eave connectors 82. The eave connectors are positioned between the upper edges of the wall panels and the inside of the roof diaphragms. Each eave connector has a first component 84. The first component has a flat face 86 coupled to a roof panel with a central cylindrical component and an exterior first arcuate plate 88. Each eave connector also has a second component 90. The second component has a U-shaped flat face 92 secured to the adjacent upper edge of the wall panels. The second component also has a central cylindrical recess 94 and a second exterior arcuate plate 96 in sliding contact with the first plate. Each adjustable eave connector has a bolt fixably coupling the arcuate plates at a predetermined angular orientation.

A pair of gable end walls 26, constructed with composite material, is provided. The gable end walls have a periphery there around. The gable end walls are intermediately angled with respect to each other to form a linear ridge at the top when the two gable walls are aligned.

Each gable end connector 97 is in a C-shaped configuration with oppositely extending apertured flanges 98 running parallel with the C-shaped channels. Bolts 99 pass through the roof diaphragms and flanges to fix-ably connect the roof diaphragms to the gable end connectors. Another bolt 99A also extends through the C-shaped channel and the vertical gable end wall for fixable coupling there between.

A new an improved building system 110 includes a plurality of panels 114, 116 formed of elastomeric foam. Each panel is fabricated in a rectangular configuration with a short upper edge 120 and a parallel lower edge 122 and with a longer inner side edge 124 and a parallel outer side edge 126 there between. Each panel also has an exterior face 128, 130 and a parallel interior face 132, 134. A thin aluminum or steel cladding 136 is secured to each face. One side edge 124 of each panel is adapted to be positioned in facing relationship with the other side edge 126 of an adjacent panel.

Each panel has one side edge formed with two vertically extending small parallel recesses 138, 140. Such recesses extend along the entire length thereof. Each panel also has one vertically extending large edge projection 142 along the entire length thereof. Each panel has the other side edge 126 formed with two vertically extending small parallel projections 144, 146. Such projections extend along the entire length of such edge. Each such edge also has one vertically extending large edge recess 148 extending along the entire length thereof. The projection and recesses of the one side edge are mutually aligned with the projections and recesses of the other side edge.

Figure 11:
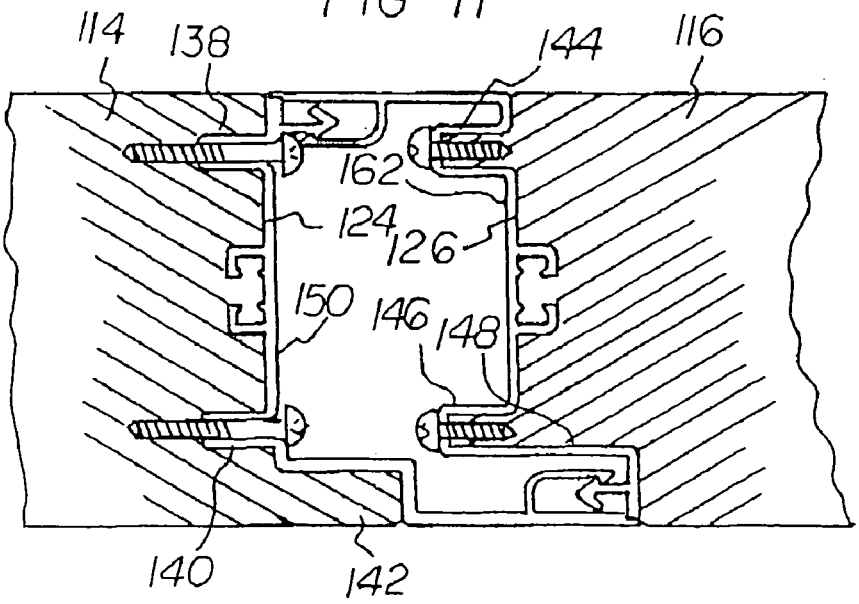
FIG. 11 is a cross-sectional view of the present invention taken along line 11—11 of FIG. 10.
Figure 14:
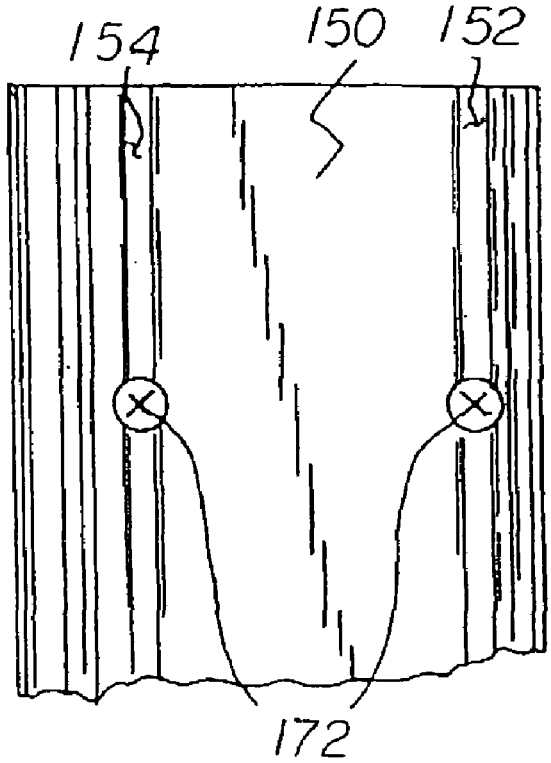
FIG. 14 is a cross-sectional view of line 14—14 of FIG. 12.
Figure 15:
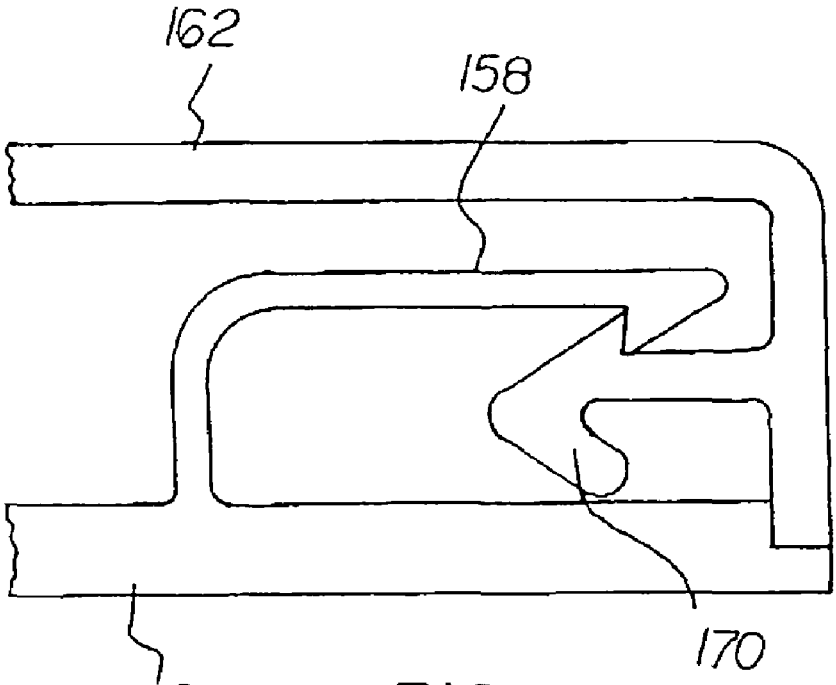
FIG. 15 is an enlarged view of circle 15 of FIG. 13.

As shown in FIG. 11, a first plate 150 is provided. Such plate is formed with two vertically extending small parallel projections 152, 154. Such projections extend along its entire length. Such projections are positioned within the recesses of the one side edge. One vertically extending large edge projection 156 extends along the entire length. Such projections are located within the edge recesses of the other side edge. The first plate also has a small spear-shaped projection 158 facing outwardly there from adjacent to one face. The first plate also has a large spear-shaped projection 160 facing outwardly there from adjacent to the other face.

A second plate 162 is formed with two vertically extending small parallel projections 164, 166. Such projections extend along the entire length of the plate. Such projections are positioned over the projections of the other side edge. The second plate also includes one vertically extending large edge recess that extends along the entire length of the plate. It is positioned within the edge recess of the other side edge. The second plate also has a small spear-shaped projection 168 that faces outwardly from the plate adjacent to one face. The second plate also includes a large spear-shaped projection 170 that faces outwardly from such plate adjacent to the other face. The large spear-like projection of each plate is in coupling relationship with the small spear-like projection of each adjacent plate during the mutual coupling of the panels with respect to each other.

A plurality of screws 172 is provided. They are located along the length of each plate and extend through the small recesses and small projections and into the foam. Such screws function for coupling each plate to its associated panel along each side edges of the plates.

In the panels as described above, there are also provided a C-shaped channel 174 which are formed along the central extent of each plate such channels extend inwardly into the foam. The channels function for as a thermal break.

Figure 16:
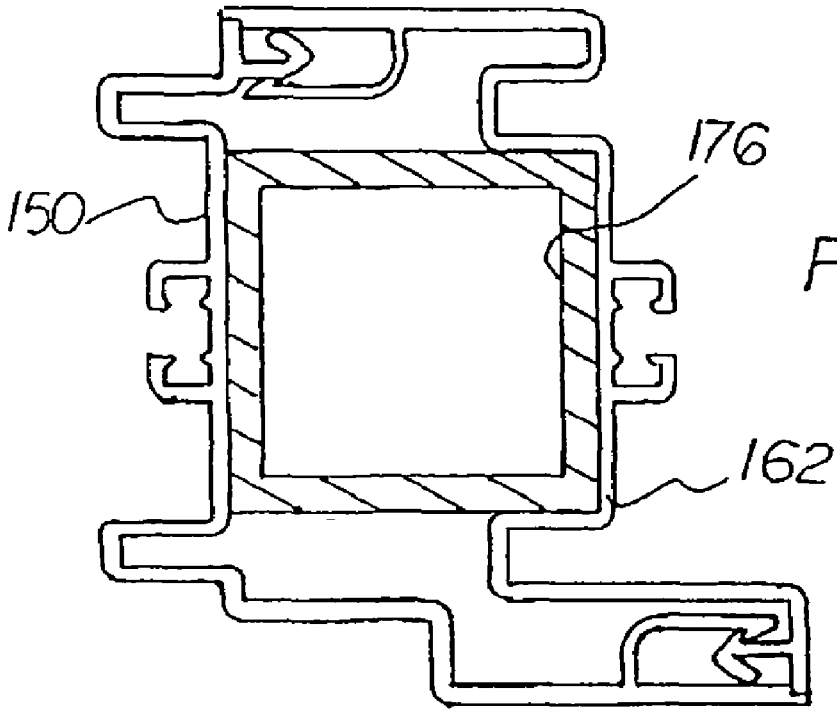
FIG. 16 is a cross-sectional view of the present invention similar to FIG. 13, but of an alternate embodiment.

The embodiment of FIG. 16 also includes an elongated steel tube 176. Such tube is in a square cross-sectional configuration. Such channel is located between the plates when coupled and provides additional structural reinforcing when needed to achieve increased design loads.

Figure 17:
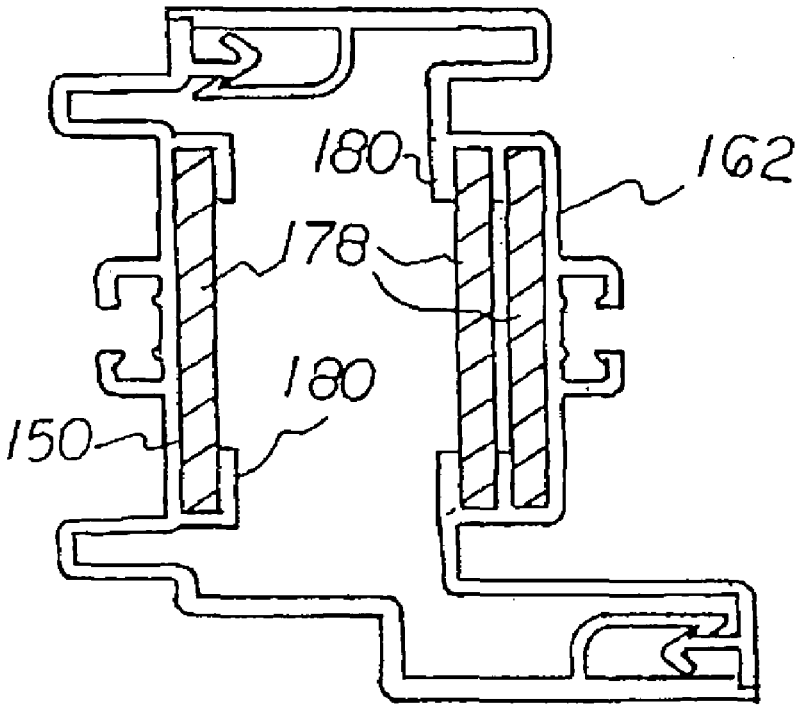
FIG. 17 is a cross-sectional view of the present invention similar to FIGS. 15 and 16 but of a further alternate embodiment.
Figure 18:
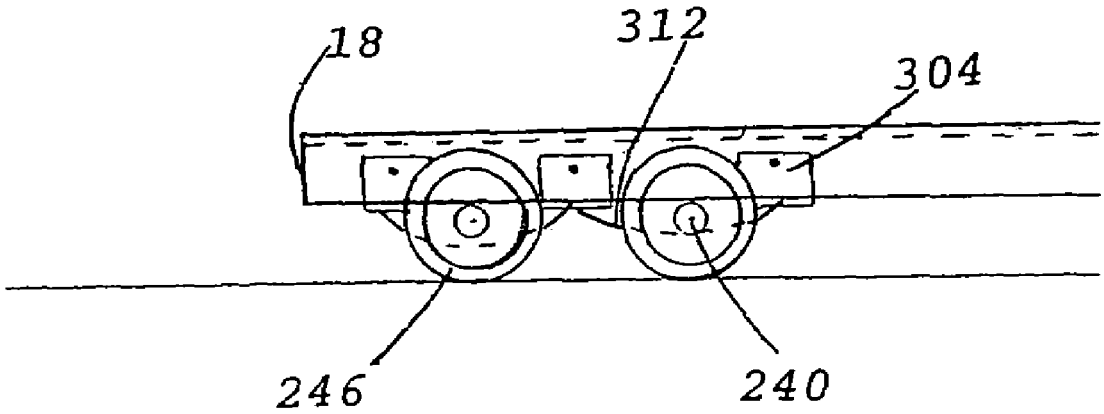
FIG. 18 is a side elevation view of the self-trailing pre-stressed concrete floor system.
Figure 19:
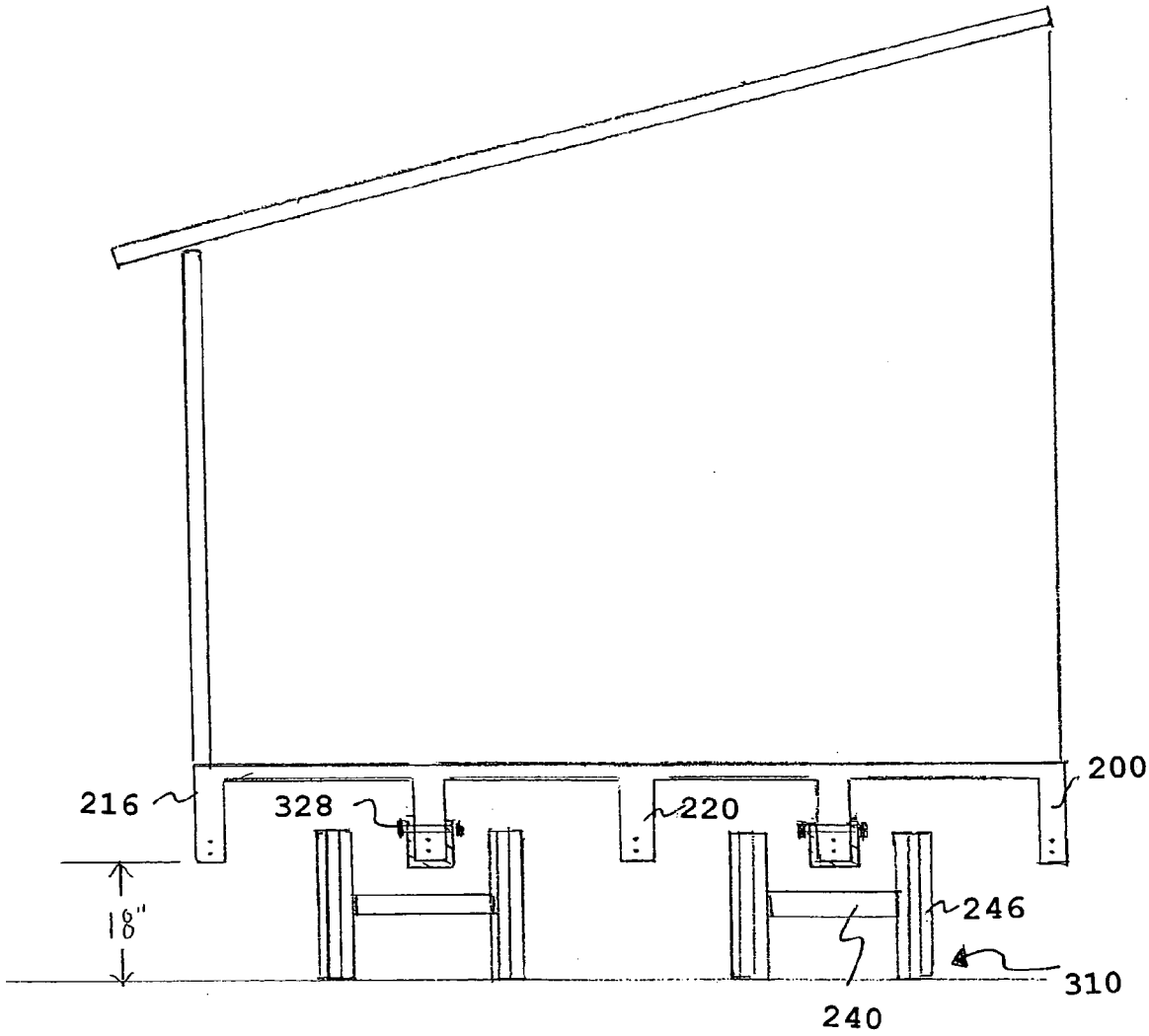
FIG. 19 is a cross sectional view of the present invention along line 19—19 of FIG. 18.
Figure 20:
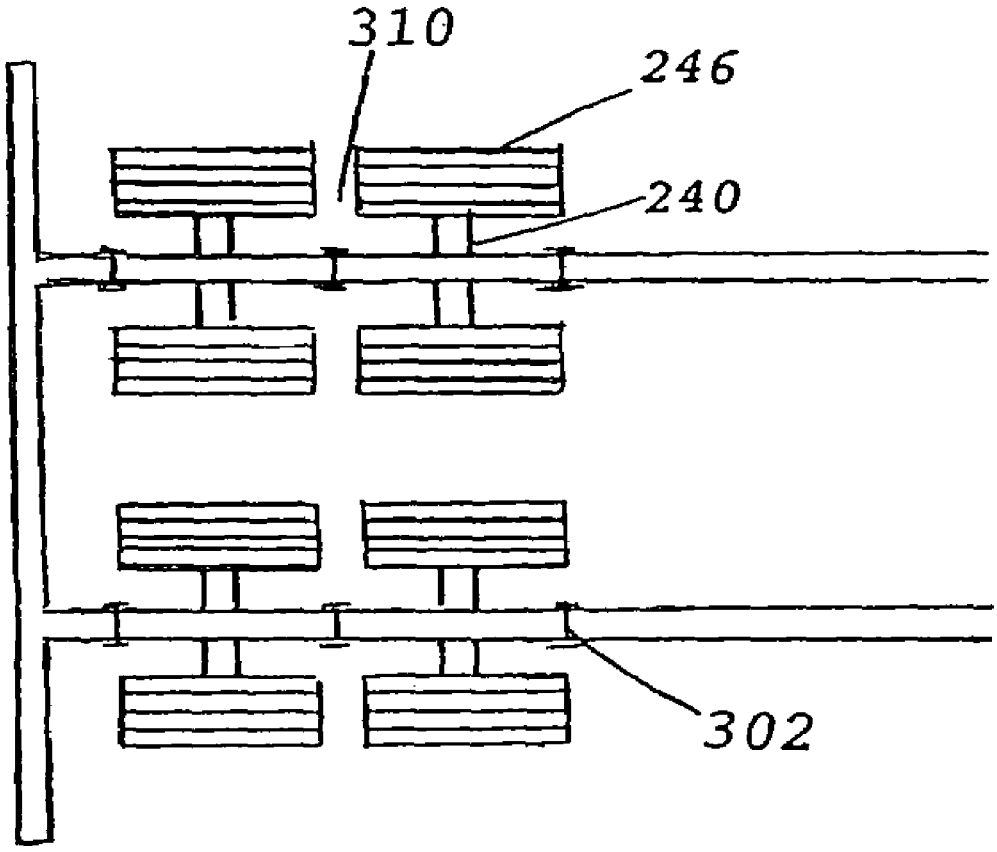
FIG. 20 is a plan view of the wheel assembly of the present invention along line 20—20 of FIG. 18.
Figure 21:
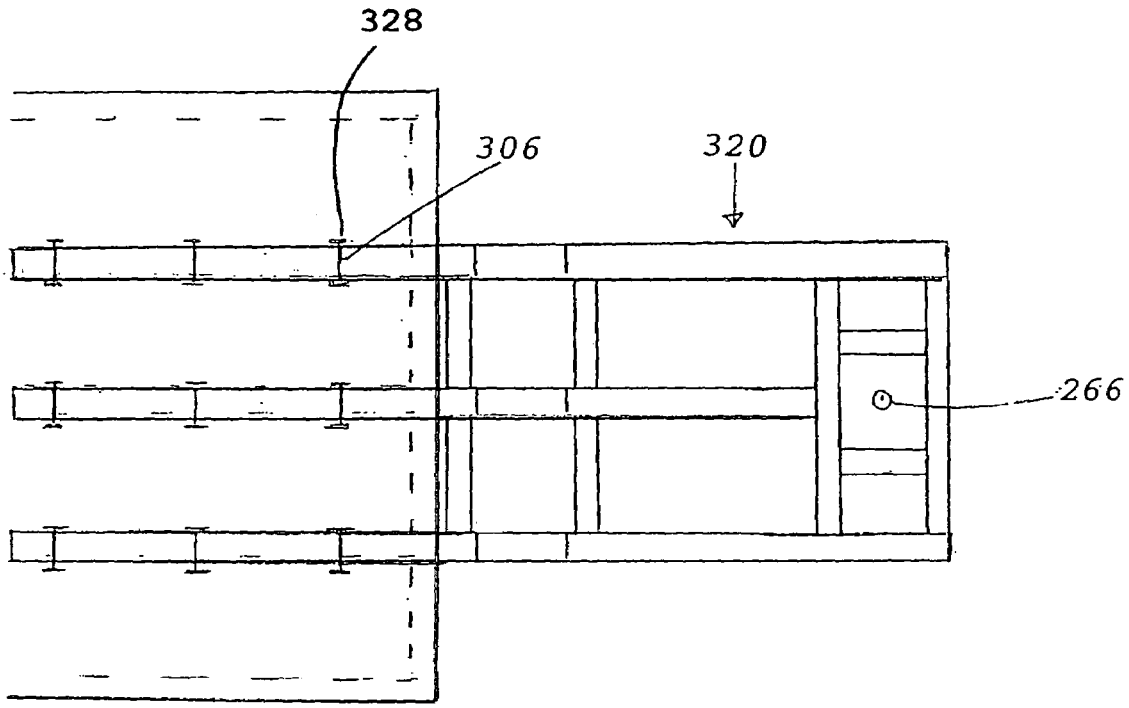
FIG. 21 is a plan view of the fifth-wheel towing assembly taken along line 21—21 of FIG. 18.
Figure 22:
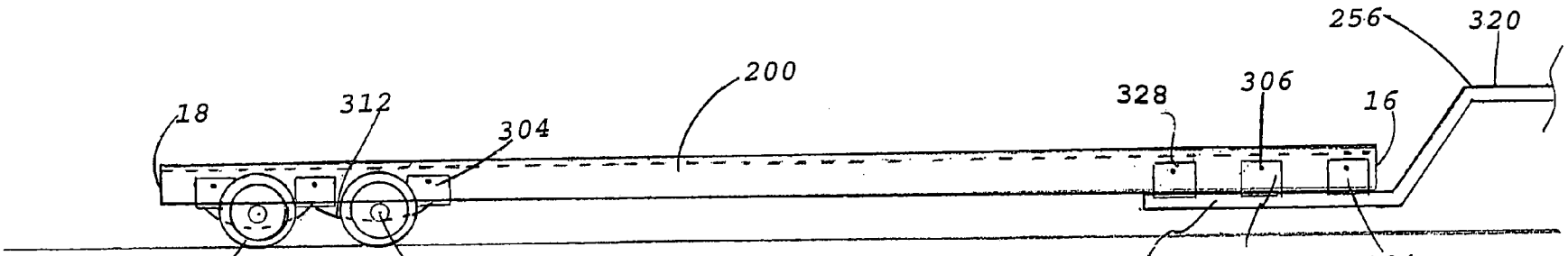
FIG. 22 is a side elevation view of the concrete floor system mounted upon a wheel assembly and also coupled to the fifth wheel hitch.
Figure 22A:
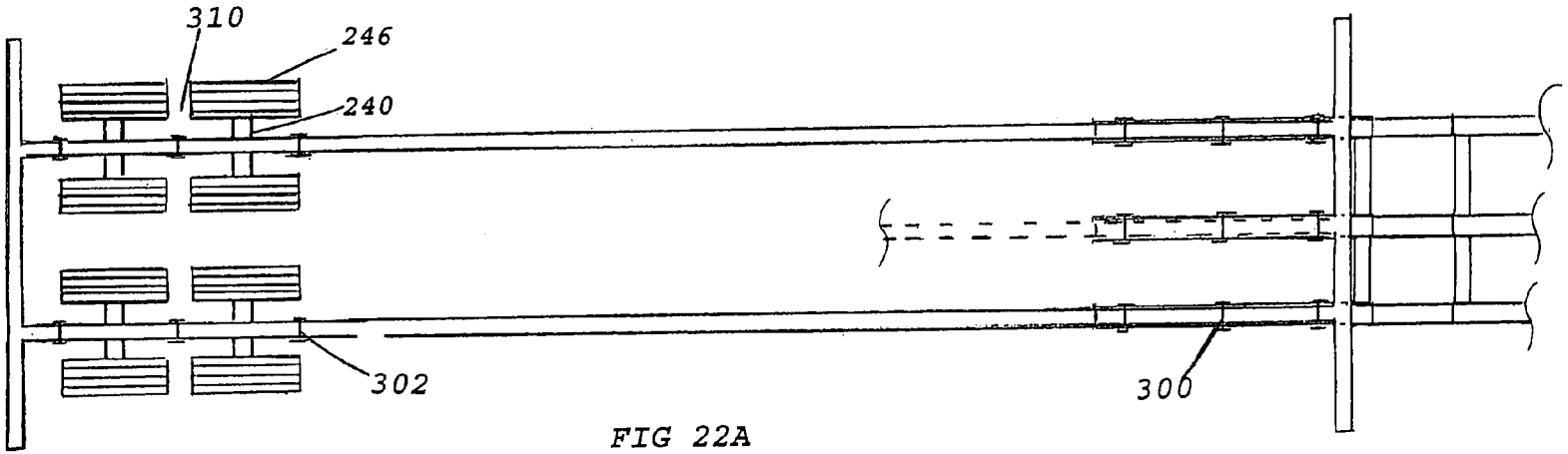
FIG. 22A is a top plan view of the concrete floor system mounted on the wheel assembly and coupled to the fifth wheel hitch.
Figure 23:
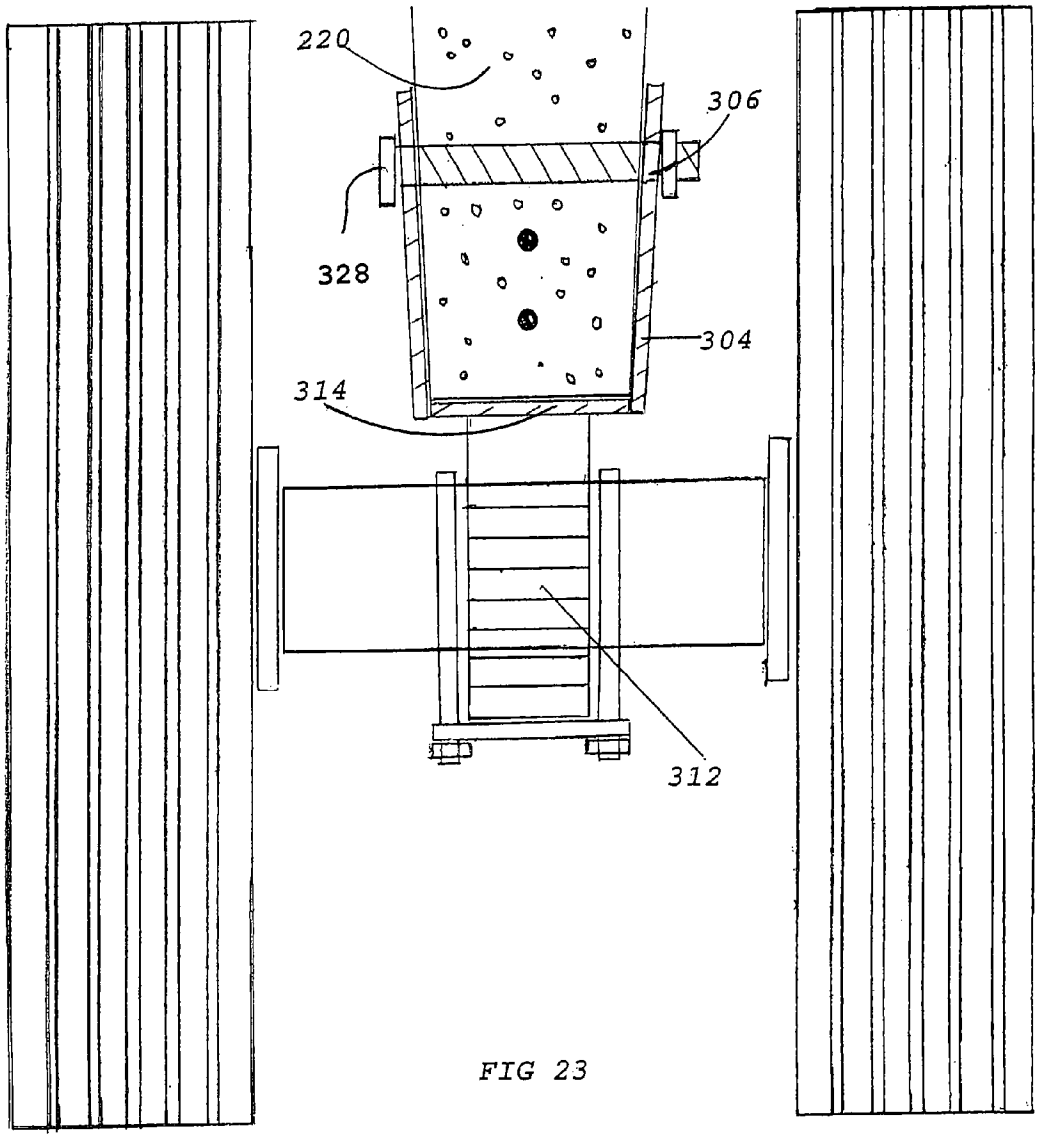
FIG. 23 is a view taken along line 23—23 of FIG. 22A, showing the wheel assembly.
Figure 23A:
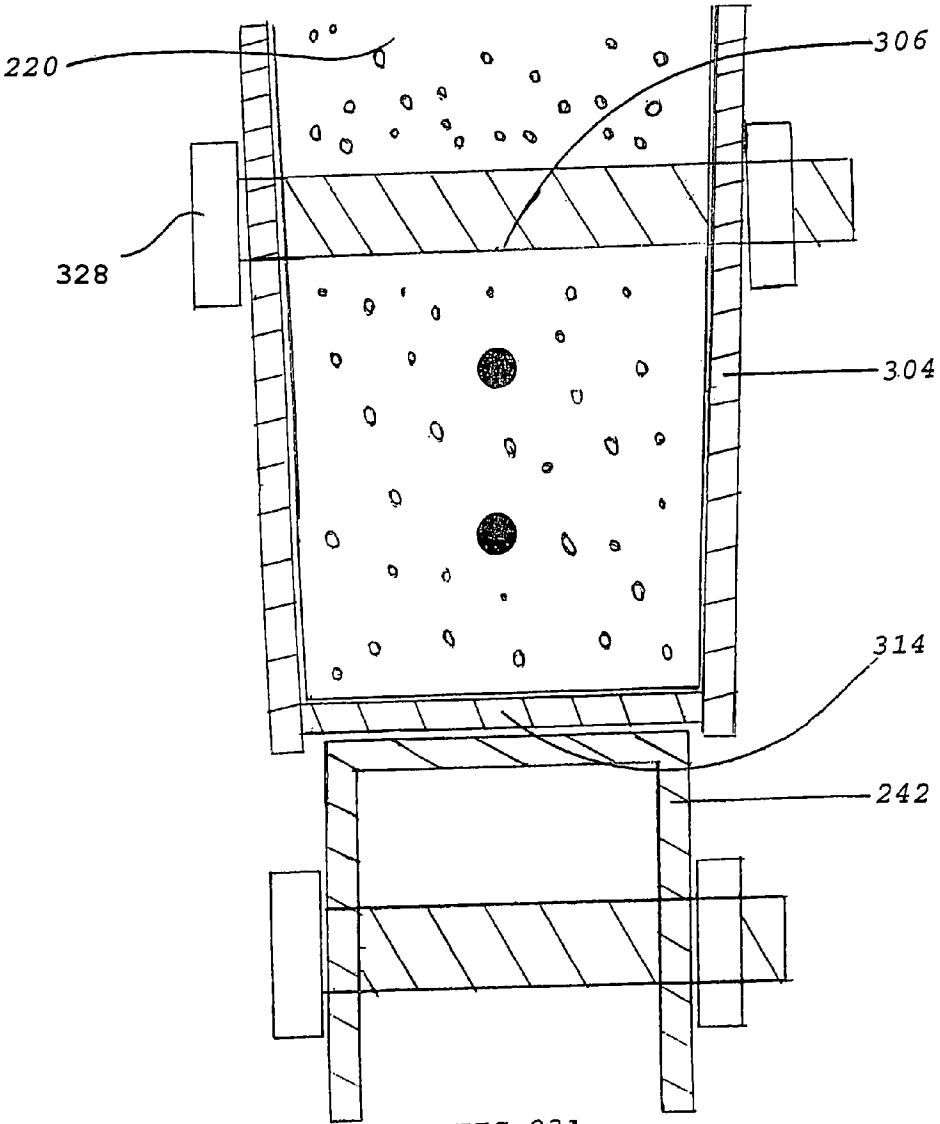
FIG. 23A is a section view from the end showing a close-up detail of the wheel assembly metallic connecting plate.
Figure 24:
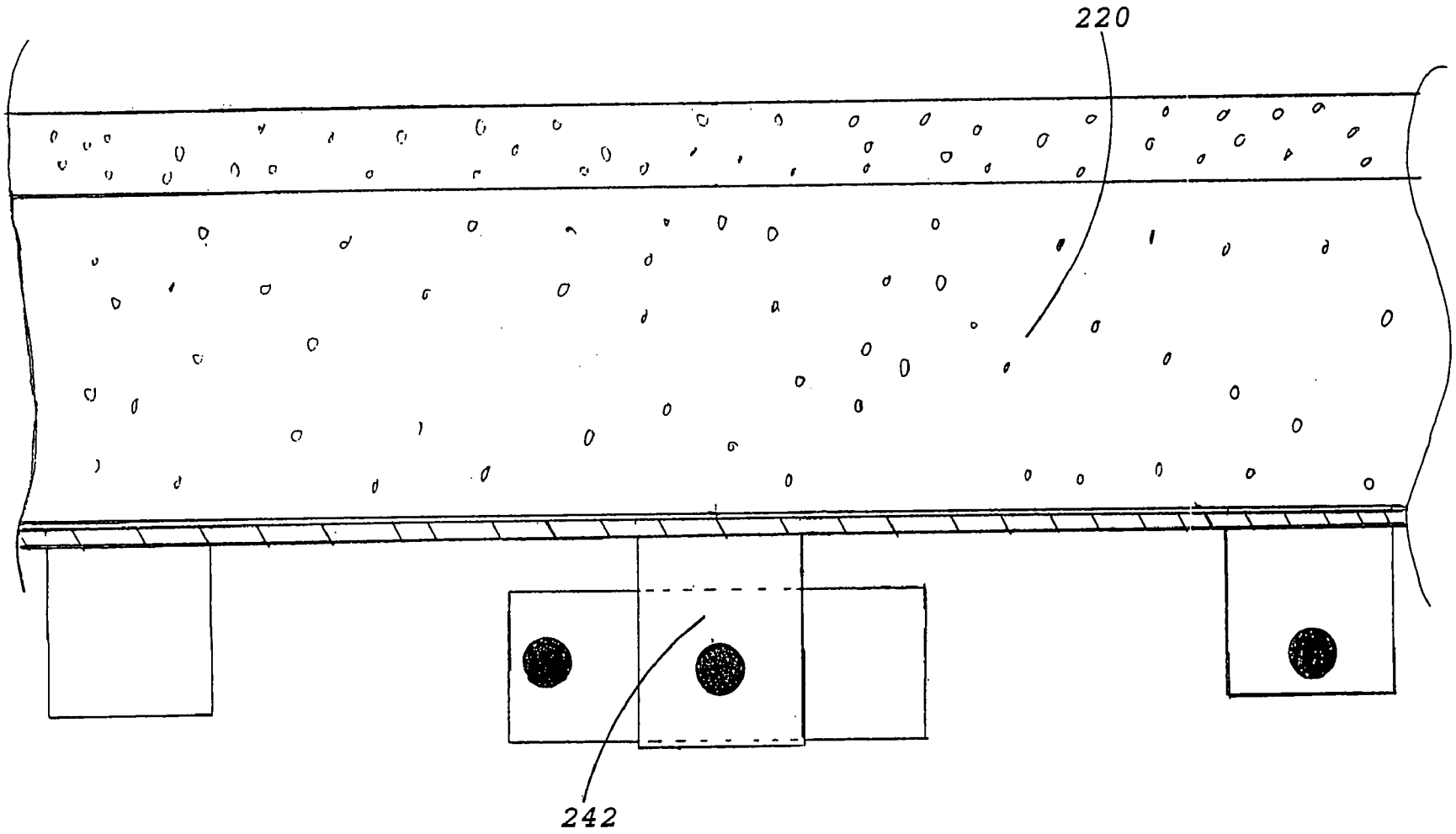
FIG. 24 is a close up side view of the leaf spring shackle assembly used to couple the wheel assembly to the intermediate stem of the concrete floor system.
Figure 25:
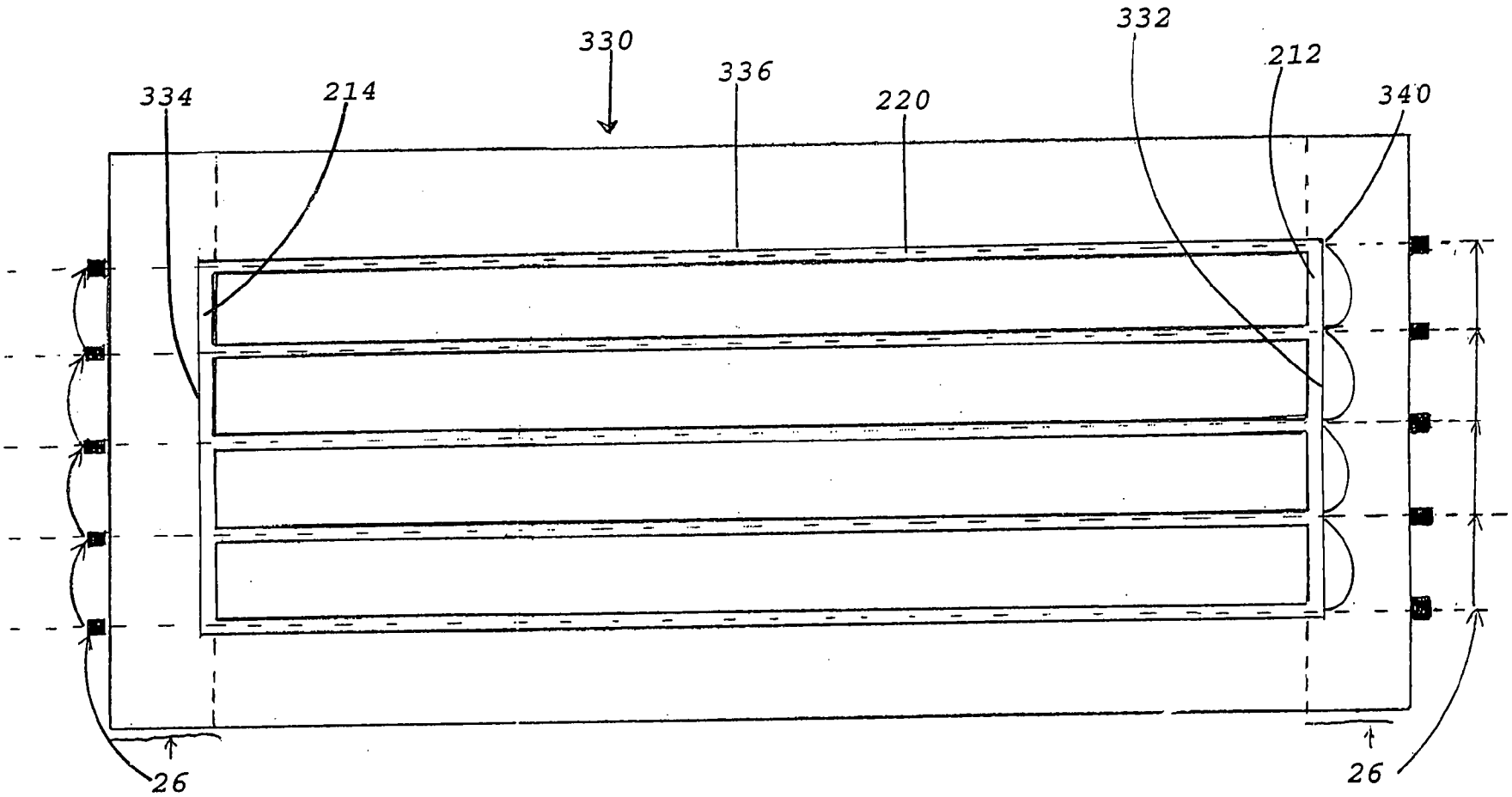
FIG. 25 is a top plan view of the self-stressing casting form showing the removable stressing heads in a closed position with the system form.
Figure 26:
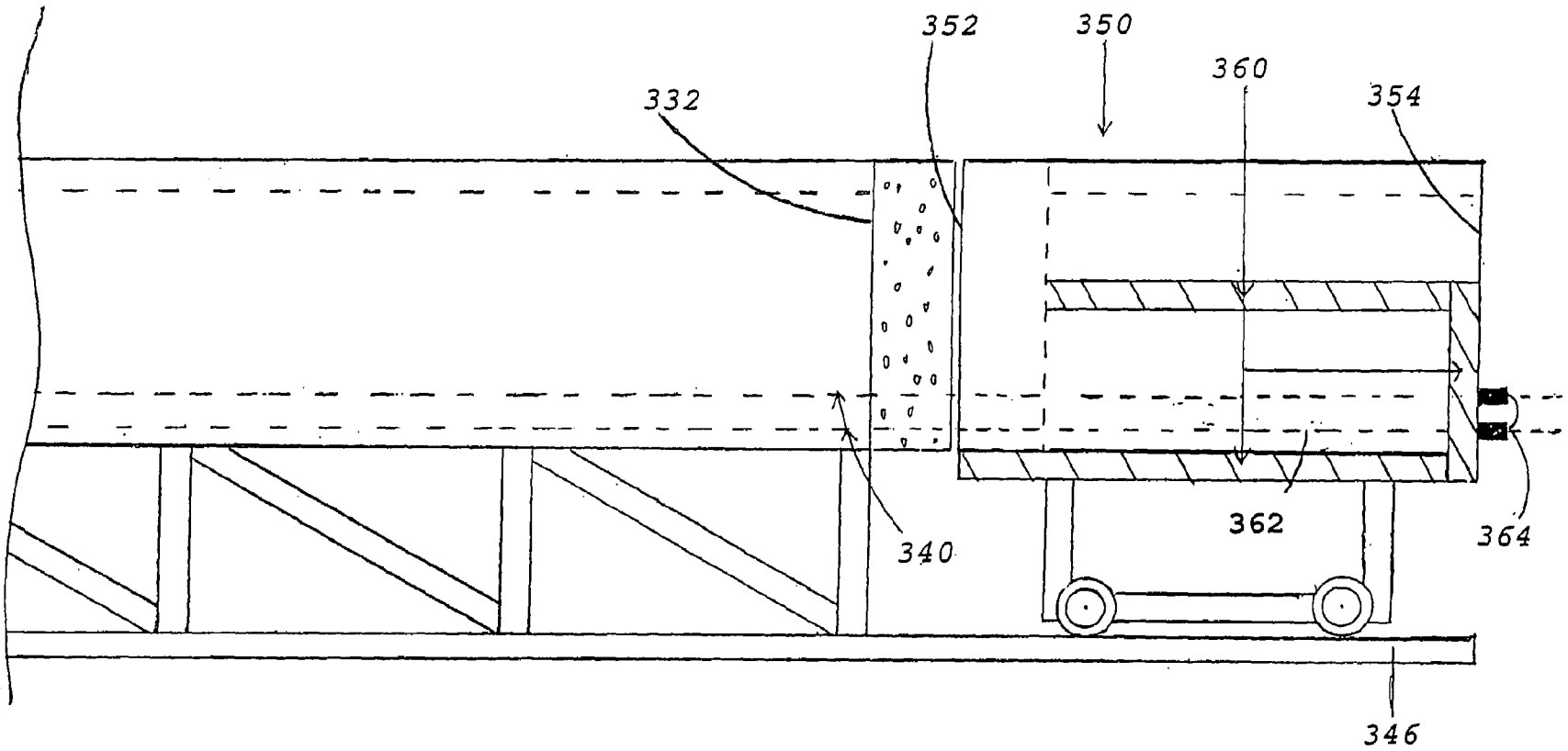
FIG. 26 is a side elevation view taken along line 26—26 of FIG. 25 showing the removable stressing heads in an open position with the system form.
Figure 29:
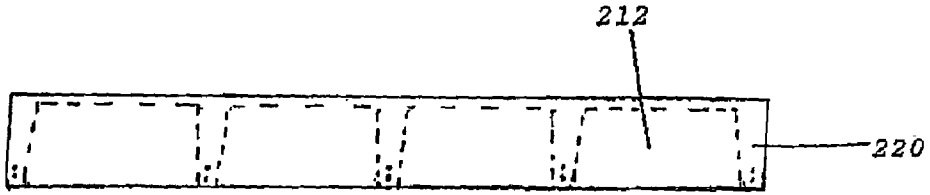
FIG. 29 is a section view of the multi-stemmed concrete floor taken along line 29—29 of FIG. 28, the view being through the reinforced diaphragm header to show the down turned stems with two stressing strands located near the bottom edge of each stem and the 2" thick flange connecting the stems across the top surface.
Figure 27:
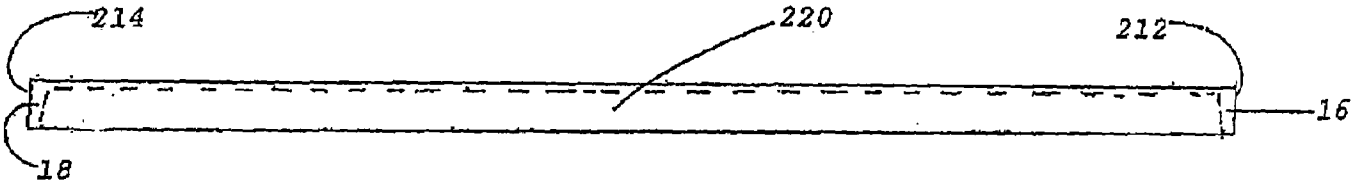
FIG. 27 is a side elevation view of the multi-stemmed concrete floor showing the front reinforced diaphragm header and the rear reinforced diaphragm header attached to and connecting the longitudinal down turned stems.
Figure 28:
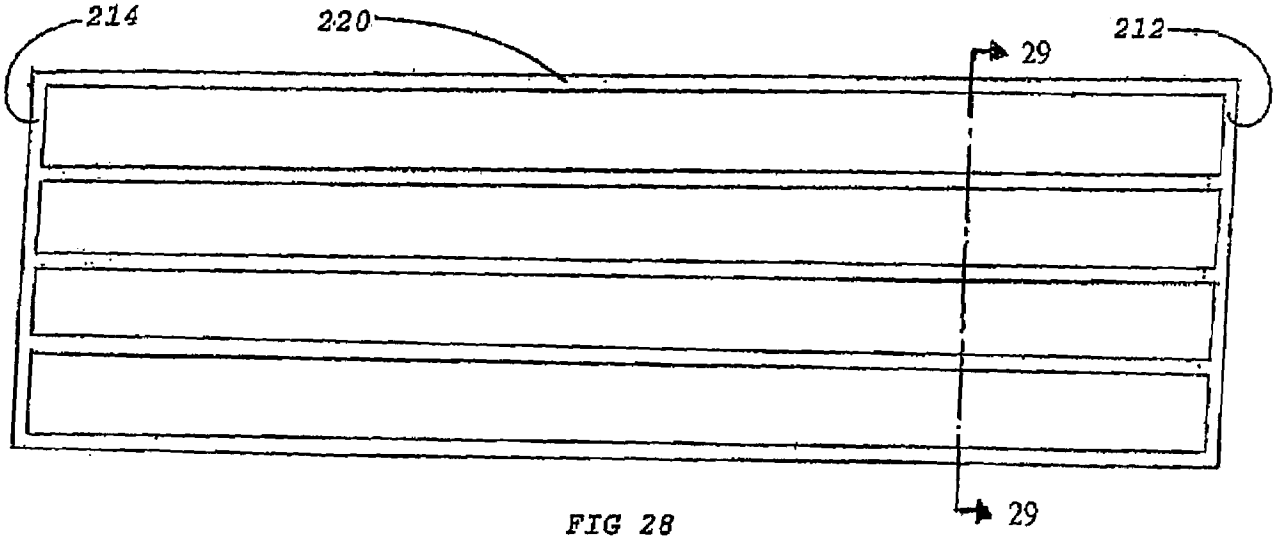
FIG. 28 is a plan view of the multi-stemmed concrete floor showing the down turned longitudinal stems connected to the reinforced diaphragm header 212, 214.
Figure 30:
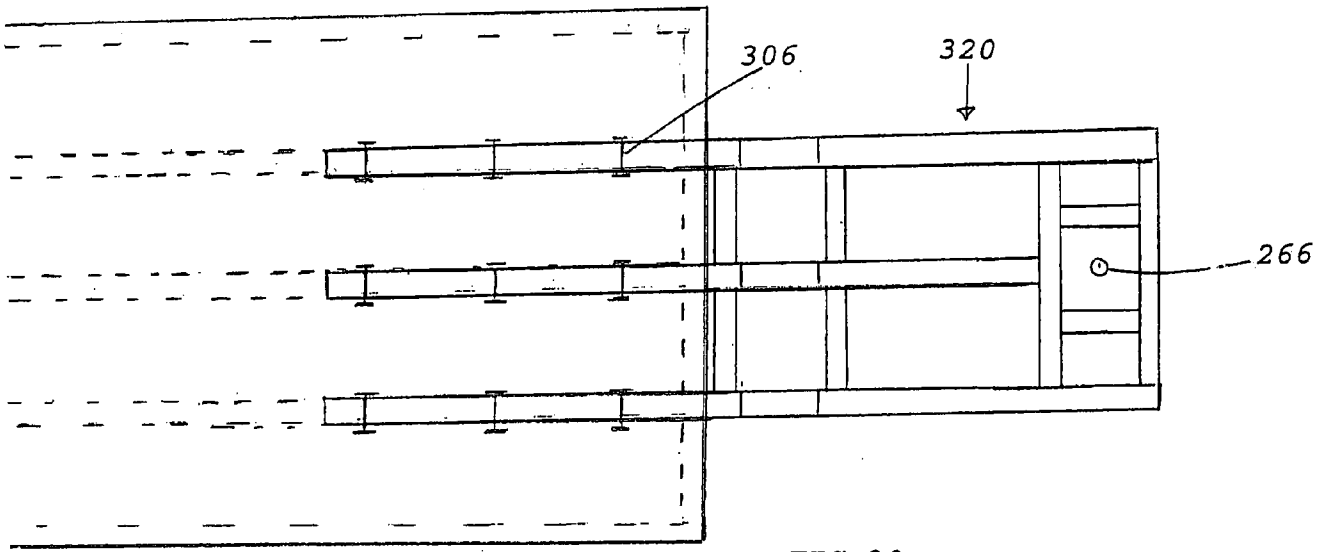
FIG. 30 is a plan view of the fifth-wheel towing assembly depicting three steel connecting beams connected to the three innermost down turned stems with nine connecting bolts inserted through the beam connecting plates and the stem.
Figure 31:
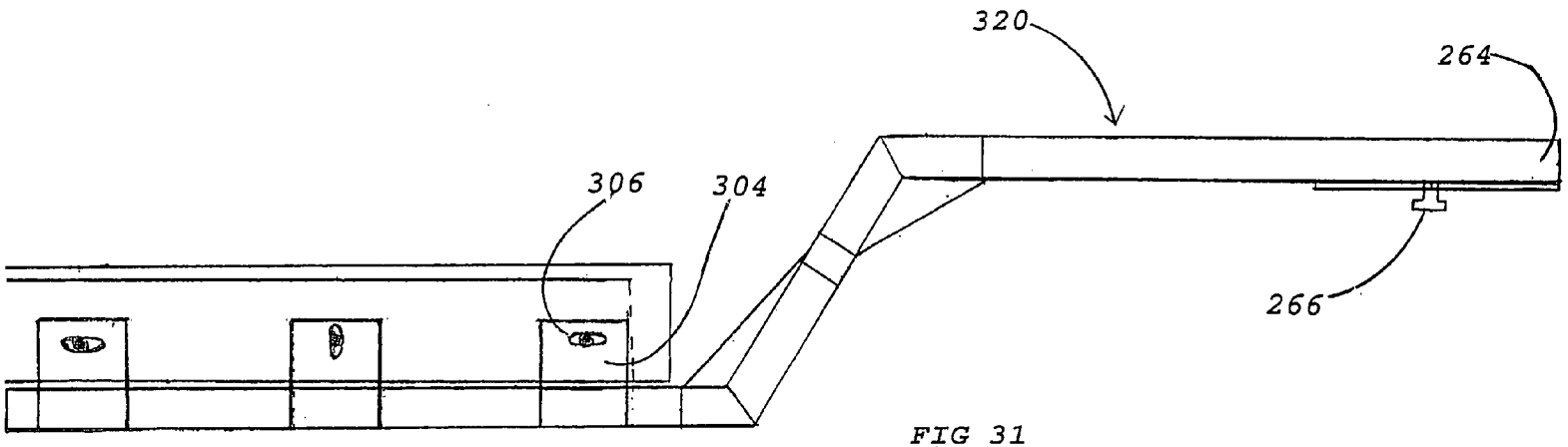
FIG. 31 is a side view of the fifth-wheel towing assembly depicting the generally Z shaped configuration with the kingpin coupling device at the towing vehicle end and the connecting beams at the opposite end.
Figure 32:
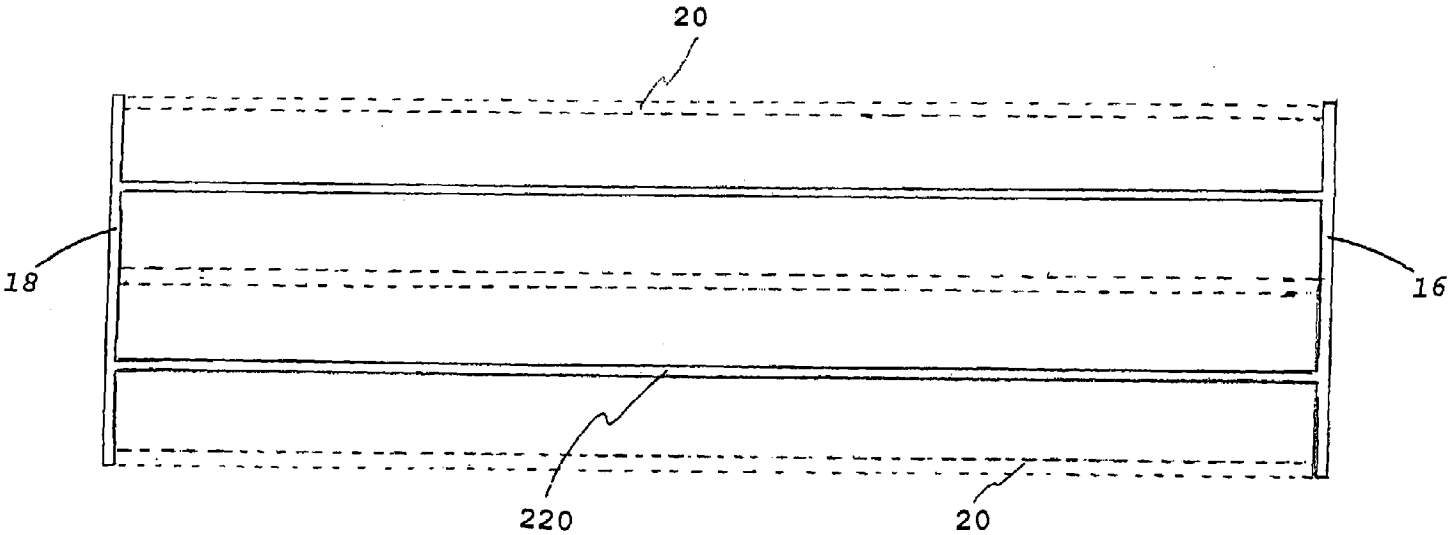
FIG. 32 is a plan view showing the main transport stems connected to and carrying the load of the reinforced diaphragm headers thereby forming a generally H shaped configuration. The transport stems are coupled to a transfer wheel assembly for the transportation of the floor system.
Figure 33:
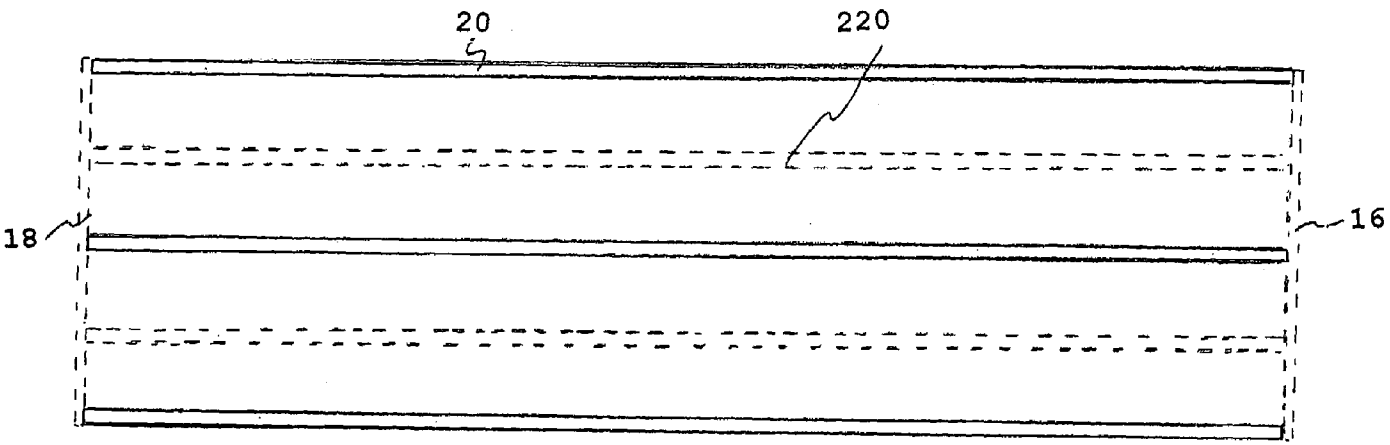
FIG. 33 is a plan view showing the additional support stems connected to and supported by the reinforced diaphragm header. The support stems are continuous with the diaphragm header and provide a stiffening of the system.
Figure 34:
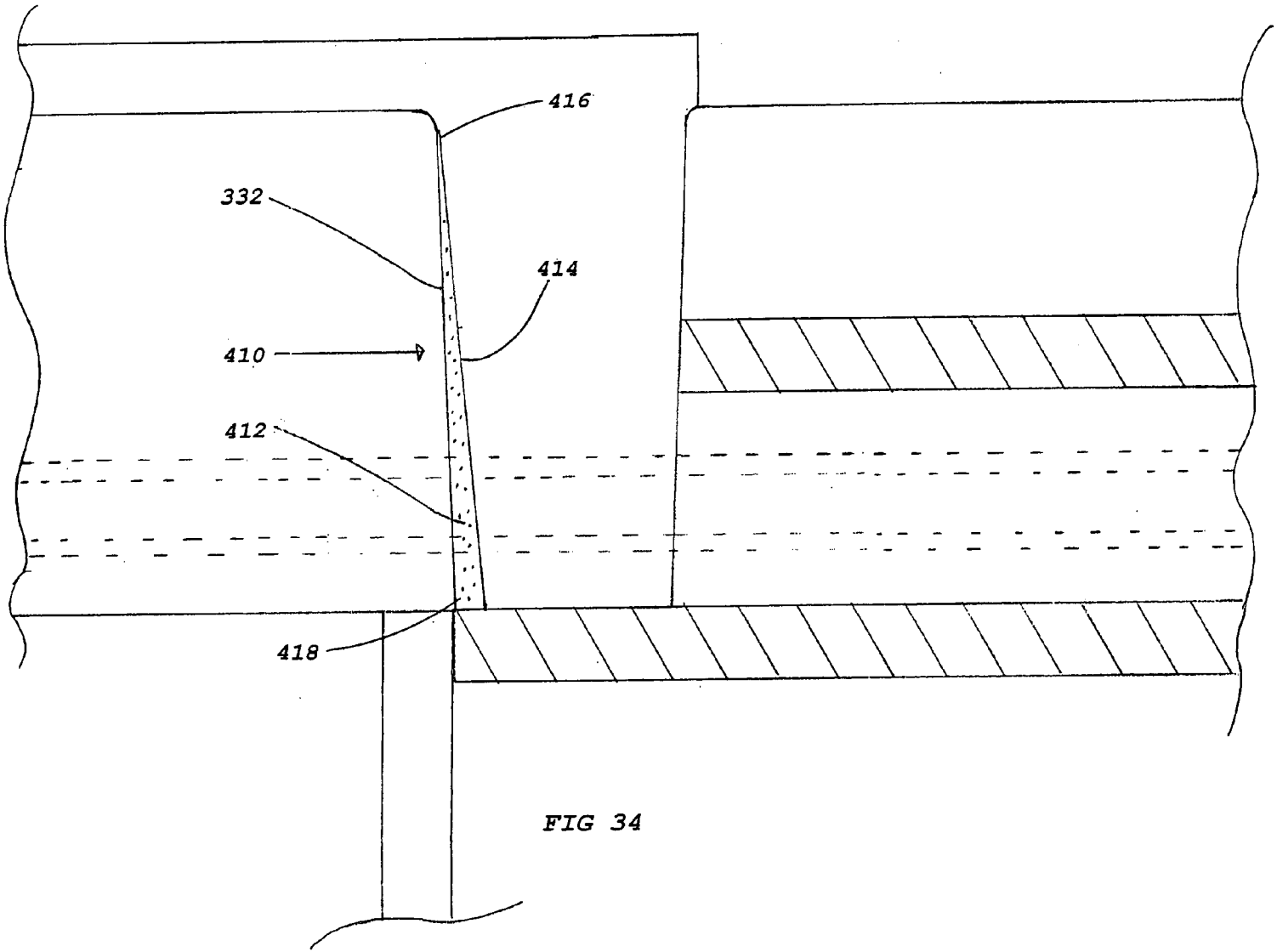
FIG. 34 is a cross sectional view of a portion of a form table utilizing the compressible filler, the table being coupled with a stressing block.

The embodiment of FIG. 17 includes two parallel steel plates 178 located between the plates in facing contact therewith. Pairs of L-shaped supports 180 are formed in the edge adapter to support the plates for a purpose similar to the FIG. 16 embodiment.

The prior art including the Hesser and Rechsteiner patents attempt to provide additional strength to composite building panels by incorporating reinforcing members that run parallel with the longitudinal edge of the building panels. Neither invention contributes sufficient strength to allow the building designer to design free-standing rigid buildings that can withstand the wind and snow loads set forth in the various building codes governing the construction of single family homes, pre-manufactured homes and school classrooms in the United States. Neither invention provides a passageway through the reinforcing member that can be used for the passage of electrical wiring, communications or plumbing. Neither invention accommodates the addition of additional internal reinforcing members needed to withstand increased wind and snow loads or longer unsupported spans. Neither invention allows the reinforcing member to be connected by thru-bolts to other structural connectors so that the entire connector system becomes an integral and structural part of the building.

This inventor has solved these problems by inventing the Self-Mating Edge Adapter FIG. 11. The Self Mating Edge Adapter (SMEA) is manufactured from aluminum by the extrusion process. It is designed to fit around the male/female edge of composite building panels and is the same depth as the panel. The SMEA is assembled in two L-shaped halves that lock together and can be the same shape or different according to the edge design of the panels to which it is fitted. Each half of the SMEA is fitted around the longitudinal edge of two opposing panels and is permanently attached with mechanical or chemical fasteners. After the two halves of the SMEA are permanently attached to the edge of opposing panels, the edges to be joined are brought together and the SMEA snaps together with an integral snap fit design and becomes permanently locked. The two L-shaped halves form an integral rectangular or square extrusion permanently positioned between and joining the two opposing composite building panels.

The rectangular or square shape of the SMEA is known to be structurally strong, in the engineering field, and is preferred over the S-shape, angles and channels described in the Hesser and Rechsteiner patents. The wall thickness of the extruded aluminum SMEA is manufactured with a sufficient thickness to provide the required structural strength and the aluminum alloy and temper can be specified as required to provide additional structural strength. Steel reinforcing bars can be inserted inside the SMEA and are held in place by channels designed within and extruded integrally with the SMEA. This effectively increases ability of the finished 8-foot high exterior wall or 13 foot long roof system to withstand the wind and snow loads and to work within the deflection limits established by the building codes.

The design features of the SMEA described above allows the building designer great flexibility with the design of free standing rigid frame buildings constructed with composite building panels. For example, the building designer is not limited to the 24 inches wide panels described in the Hesser and Rechsteiner patents because the structural strength of the SMEA will permit the spacing between the longitudinal reinforcing member to be increased to 30 to 48 inches. This allows greater freedom in the selection of manufacturers of composite building panels because not all manufacturers produce the same panel widths.

Single-family homes and other similar buildings all need conduits or passageways for the installation of electrical wiring, communications and plumbing. The SMEA provides a completely enclosed hollow passageway for the installation of these materials. Wiring and plumbing can be installed from the floor and passed vertically through the center of the SMEA connecting the exterior wall panels. The wiring or plumbing is then passed through the structural connector holding the sloping roof to the vertical wall. The wiring or plumbing can then be passed through the center of the SMEA connecting the sloping roof diaphragms. This permits all areas of the building to be accessed by the electrical wiring, communication systems or plumbing as needed.

The SMEA is designed with slots on the inside that can be used to vertically slide steel bars for additional reinforcing. This allows the building designer to design single-family homes with higher exterior walls and longer sloping roofs.

This also allows the buildings to be designed to meet the higher wind loads that are found in the southern U.S. such as in the State of Florida or higher snow loads such as are found in Canada.

The SMEA is designed with a thermal break in each half of the L-shaped assembly. The thermal break prevents the passage of heat or cold from the exterior surface to the interior surface of the SMEA. This maintains the thermal integrity of the composite building panels for an entire thermal break design. Buildings constructed with composite building panels and the SMEA provide a total thermally efficient building envelope for optimum energy efficiency.

The SMEA can be fitted into other components necessary to erect single-family homes and other buildings. These components include exterior wall to floor connections such as is depicted in the Wolfe U.S. Pat. No. 5,901,514 and the roof ridge connection such as depicted in the Wolfe U.S. Pat. No. 5,826,380 and the outside corner connection such as is depicted in the Wolfe U.S. Pat. No. 6,119,410. The SMEA is designed to fit into these components and is connected to them by drilling a hole and passing a hardened steel bolt completely through the SMEA and connector. This method of connection is referred to as "thru bolting". Thru bolting is the most structurally sound method of making this connection and is preferred over using a multitude of screws or rivets such as is depicted in the Hesser and Rechsteiner patents. Buildings designed and assembled with the SMEA and other structural connectors such as is depicted in the Wolfe patents provide a completely integral structural assembly that is able to resist the wind and snow loads in any geographic location.

In today's rapidly changing world there are many new advances in the fields of science, technology, medicine and other fields such as the building industry. The building industry is constantly looking for ways to construct buildings faster, more economically, stronger and with materials that are renewable and do not pollute the environment. Some day our natural resources, such as the oil that is consumed to produce many building materials and the trees that are used to produce wood framed structures, will run out. The shortage of these raw materials is driving the price higher for building materials higher. Over the past thirty years, the cost to construct single-family homes, pre-manufactured housing and school classrooms has skyrocketed. In the face of these economic and environmental conditions it is necessary to develop alternate building materials and systems that are structurally sound, cost effective and environmentally safe.

Buildings constructed with composite building panels manufactured with metal skins and polyurethane foam cores answer these needs. As with any new product, the design development is often a matter of trial and error. Both the Hesser and Rechsteiner patents identify the potential application for composite building panels in the manufacture of free standing rigid frame buildings. Both recognize the need to solve the problem of flexibility and/or excessive deflection under wind and snow loads and both offer a potential solution. However, neither solution is adequate to provide the amount of reinforcing required to support the use of composite building panels in free standing rigid frame structures. These patents can only be considered trials in the development of this alternate building system.

The Self Mating Edge Adapter is the next step in the design development of this much-needed building system and offers the first positive and effective solution to the problem of excessive deflection of the composite building panels. The SMEA is a new and useful invention for use in the building industry.

The self-trailing multi-stemmed pre-stressed concrete floor system allows for trailer-less transportation. It is comprised of a generally rectangular shape with two long parallel sides and two short parallel ends. Such multi-stemmed floors constitute the floor of the finished building. The topside of the multi-stemmed floor is flat while the bottom side is comprised of a plurality of stems that extend downward and are evenly spaced. Each stem is pre-stressed with two half-inch steel strands running longitudinally from each short end. Each strand is stretched to 31,000 pounds of force and the force is transferred to the concrete stem via a load transfer device. A typical pre-stressed system having five stems, also known as a "Ouint T" slab (five stems), is therefore stressed with 310,000 pounds of force.

Each long stem is supported on the ends with a reinforced diaphragm header beam, also referred to as a diaphragm header. The diaphragm header is designed to transfer the live and dead loads exerted on the long stems to the end diaphragm. The end diaphragm transfers all of the longitudinal loads exerted on the stems, horizontally, to the foundation pads. The end diaphragm also holds the separate stems of a Quint-T self-trailing multi-stemmed floor together during transport down the highway.

The Quint-T floor slab with end diaphragm headers enable the concrete floor system of a manufactured building to be transported over the highway without the need to support the concrete floor slab by any other means such as a flat bed trailer, Gurney, bogey, railroad car or other means of carrying as would be required for a conventional, flat concrete slab or those depicted by Davenport and Eubanks. The new and innovative design of the Quint-T concrete slab comprised of longitudinal stems and diaphragm header creates a strong structure that will not crack or break during transport as would occur with conventional, flat concrete slabs.

The Quint-T slab is easily transported by connecting 30 inch high lo-boy wheels attached to short axles and mounting plates which is then connected directly to the down turned concrete stems. The wheels are located between the two outermost stems and the two adjacent inner stems. The wheel assembly is easily attached and detached by inserting bolts that are passed through the steel mounting plates and the intermediate stems.

The wheels are partially concealed between the down turned stems with the upper ⅓ of the wheels extending upward into the open space between the 16 inch high down turned stems. This is important because it is desirable to place the bottom side of the multi-stemmed floor system as close to the roadway as is possible. The combination of the special lo-boy wheels and the concealment of the upper ⅓ of the wheel between the 16-inch high stems enable the self-trailing multi-stemmed concrete floor to align with the roadway with a minimal clearance. A small space between the roadway and the bottom side of the concrete floor system enables the finished manufactured home to be transported close to the ground thereby reducing the overall building height from the bottom of the building to the top of the roof. It is desirable to keep the top of the building as low as possible to enable the building to pass under bridges and electrical power lines during transport from the factory to the building site. This enables the buildings to be constructed with a higher roof pitch than is normally available in the prior art.

A steel 5th-wheel towing device is connected to one of the reinforced diaphragm headers with bolts that are passed through apertures that are formed in the stems, the apertures being in the three innermost longitudinal stems. The towing device is connected to the ball and socket hook-up device of a standard tractor-trailer truck and moved from the factory to the building site.

The system further includes a pre-stressed concrete floor system 200, also known as a multi-stemmed floor. A pre-stressed multi-stemmed floor 204 is provided. The multi-stemmed floor has a lower section 206 with an upper surface 208 and a lower surface 210. The upper section also has a short front edge, or reinforced diaphragm header 212 and a parallel short rear edge, or reinforced diaphragm header 214 and parallel long side edges 216 there between.

Next provided are five downwardly extending stems 220. The stems are at spaced locations along the lower surface of the base slab. Each stem extends between the front edge and the rear edge and is in spaced parallel relationship with the side edges.

A pair of vertically spaced 2" stressing strands 224 are next provided. The strands, also known as stressing cables, are located within each of the longitudinal stems extending between the front reinforced diaphragm header and the rear reinforced diaphragm header.

Next provided is a rigid metallic support plate 228. The support plate is attached to the two intermediate stems adjacent to the outer stems and adjacent to the rear diaphragm header. The U-shaped support plates encompass the lower extents of the stems 230.

Horizontal attachment apertures 234 are formed in the intermediate stems. Coupling bolts 236 are inserted through the apertures and the metallic support plate for a release-able connection of the wheel assembly to the stem there between.

Next provided are four short axles 240. The axles extend parallel with the front edge and rear edge adjacent to the support plate and extended upwardly to the attachment components 242 coupling the axle and the support plate.

A plurality of wheels 246 is provided. The wheels are rotatably supported at the ends of the axle.

Lastly, a rectangular coupler 256 is provided. The coupler has an L-shaped base 258. The base has horizontally spaced holes 260 aligned with the holes of the supplemental projection. Bolts 262 are provided through the holes 260 for a releasable coupling. The coupler also has an apex 264 with a downwardly extending kingpin 266 for releasable coupling of the multi-stemmed floor to a vehicle to thereby facilitate transportation.

An alternate embodiment of a method to transport the multi-stemmed floor to a location comprises several components, in combination.

First provided is a pair of multi-stemmed concrete floors 200. Each multi-stemmed floor has a generally rectangular configuration with an up side and a down side and a thickness there between. Each multi-stemmed floor has two parallel side edges and two parallel end edges, with one end edge being the front end and one end edge being the rear end. Each multi-stemmed floor has a downwardly disposed short front reinforced diaphragm header 212 and a parallel downwardly disposed rear reinforced diaphragm header 214 and a plurality of long downwardly disposed stems there between.

All stems 220 of each multi-stemmed floor are perpendicular to the reinforced diaphragm headers and all stems have a pair of stressing cables running the length of the stems and through the front diaphragm header and through the rear diaphragm header. Two of the stems of each multi-stemmed floor are located on and contiguous with the side edges of the multi-stemmed floor and form the side edges of each multi-stemmed floor. The side edge of a multi-stemmed floor is configured to contact the side edge of another multi-stemmed floor to form a central joining edge of the coupled multi-stemmed floors to form a floor system of a building. The stems of each multi-stemmed floor are the inner stems and the edge stems. The inner stems are between the two edge stems. The front inner stems each have a plurality of fifth wheel coupling bolt holes 300 there through. The rear inner stems, that are adjacent the side edge stems, each have a plurality of suspension shackle mounting holes 302 there through.

Next provided is a plurality of rigid metallic suspension shackle mounting plates 304. Each of the shackle mounting plates has a squared U-shaped configuration, with each plate receiving and snugly fitting the downwardly projecting stem of the multi-stemmed floor. Each of the plates has a bolt hole 306 there through. The bolt hole is align able with the suspension shackle mounting bolt holes of the stems, that are adjacent to the rear edge and side edge of the multi-stemmed floor.

A wheel assembly 310 having a plurality of axles with a plurality of wheels 246 being rotatably coupled to each of the axles 240 is next provided. Each axle is coupled to a pair of parallel suspension springs 312, and each suspension spring being coupled to one of a pair of suspension carrying plates 314. The suspension carrying plate is coupled to a plurality of suspension shackle mounting plates, allowing the wheel assembly to be removably coupled to the multi-stemmed floor to allow the multi-stemmed floor to be trailed with a road clearance sufficient to be used on all roadways without restriction.

Next provided is a fifth wheel subassembly having a hitching portion 320 for releasable attachment to a tractor hitch and an attachment portion for coupling with a multi-stemmed floor. The attachment portion has a plurality of rearward extending carrier beams 322. Each carrier beam has a plurality of rigid metallic suspension shackle mounting plates 324 with each plate having a squared U-shaped configuration. Each plate is received and snugly fitted to the downwardly projecting stem of the multi-stemmed floor. Each of the plates has a bolt hole there through 306 with the bolt hole being align able with the fifth wheel coupling bolt holes of the front inner stems of the multi-stemmed floor. The bolting of the subassembly to the multi-stemmed floor allows the fifth wheel subassembly to be removably coupled to the multi-stemmed floor to allow the multi-stemmed floor to be transported with a minimal road clearance sufficient to be used on all roadways without restriction.

Lastly provided is a plurality of bolts 328 to couple the multi-stemmed floor to the wheel assembly and the fifth wheel subassembly, thereby allowing the multi-stemmed floor to be pulled from one location to another with ease and safely.

Another aspect of this invention is a pre-stressed multi-stemmed concrete floor manufacture station. The method of making a multi-stemmed floor, herein disclosed, allows a user to make a pre-stressed multi-stemmed floor in a safe and efficient manner. The station comprises several components in combination.

First provided are a multi-stemmed floor form table 330 having an open front face 332 and an open rear face 334 and two parallel side surfaces and a bottom surface and a long axis. The bottom surface of the form table has a plurality of downward projecting troughs 336, therein. The troughs run the length of the table and extend to the front and rear faces. There is a front trough meeting the front face and a rear trough meeting the rear face of the form table. The front and rear troughs are each oriented perpendicular to the longitudinal troughs, at the front and rear of the multi-stemmed floor form table. The front trough and rear trough of the multi-stemmed floor form the front and rear diaphragm headers of the finished multi-stemmed floor. The downward projecting troughs are the molding walls for the formation of the downward projections of a multi-stemmed floor, also known as stems and diaphragm headers. The front and rear faces each allow the passage of a plurality of pairs of stressing cables there through.

Next provided is two pair of trolley rails 346. One pair is located adjacent the front of the multi-stemmed floor form table and one pair is located adjacent the rear end of the multi-stemmed floor form table. The rails lie in line with the long axis of the multi-stemmed floor form table and run up to the front surface and the rear surface of the multi-stemmed floor form table.

Next provided is a pair of removable stressing heads 350 with each stressing head having a plurality of rail wheels being mated with and received by the trolley rails. Each removable stressing head has a recessed front surface 352 which joins with the front and rear faces of the form table. The joining of the stressing head and the form table makes a containment surface for the poured concrete into the form table. Each removable stressing head has two parallel short end surfaces and a flat rear end surface 354, a top surface and a bottom surface. Each stressing head has an associated stressing block 360 coupled thereto. The stressing block has a first weight constructed with 2" thick steel plate with the side edges oriented in a parallel direction to the stressing strands also defined as the "primary beam". The 2" thick steel plate is turned in the strong direction to the force exerted on the form by the stressing strands and spans the entire width of the form. The stressing block has a second weight constructed of 2" thick steel plate with the flat face surface turned perpendicular to the stressing strands also defined as the "chuck bearing block". The stressing block assembly carries the entire force exerted by the stressing strands. Hence the term "self-stressing form" is used to describe this assembly. The chuck-bearing block has a plurality of pairs of stressing cable apertures 362 there through for receiving and containing a stressing cable. Each stressing head also has a plurality of stressing cable lock-downs 364, also known as chucks. The chucks are coupleable to the stressing cable via an internal clamping device. Stretching the strand approximately 4" more than its un-tensioned length with 31,000 lbs of force tensions the stressing strand. The chucks clamp to the stressing strand passed through the chuck-bearing block and hold the pre-stressed strand in place by contacting the flat face surface on the chuck-bearing block. The lock-downs, or chucks, couple with the cable and prevent the removal of the stressing cable from within the cable apertures. Each removable stressing head is coupled to a pair of trolley rails. The removable stressing head can be rolled to an open position, which is away from the form table, and the removable stressing head can be rolled to a closed position, in which it is coupled to the form table by the force exerted on the stressing head by the pre-stressed strands.

When in the closed position, each stressing head abuts the end face of the form table to make a containment for the formation of the diaphragm header forming troughs at the contact surfaces 332 and 352. There is one stressing head at the front end of the form table and a stressing head at the rear of the form table. Each removable stressing head is coupled to the movable trolley. Each removable stressing head has passageways there through (not shown) with the passageways allowing the stressing cables to pass through each of the stressing heads to the stressing block. In this manner the stressing heads, in conjunction with the stressing blocks, restrain the entire stressing force of the stressing cables, the cables also being known as strands. Hence the form table is defined as a "self-stressing form".

When the strands are fully stressed, thereby holding the removable stressing head in place, the stressing head is in the closed position and forms the diaphragm header. The stressing strands or cables are located near the bottom edge of the longitudinal down turned stems and pass through the diaphragm header trough and stressing block. The concrete can be poured into the self-stressing form to encapsulate the strands and is allowed to cure to a desired strength in excess of 5,000 psi. After the concrete has cured the stressing strands are cut at a location outside the diaphragm header-forming trough but to the inside of the stressing block. This transfers the entire force of the pre-stressed cables or strands from the self-stressing form to the fully cured multi-stemmed concrete floor system. If a simple table, absent the stressing head configuration would be used, there would be a problem at this step in the process. The multi-stemmed floor would not be able to be removed from the form due to the approximately 6" of strand left protruding through the flat rear surface 354 of the diaphragm header forming trough. The inventor has solved this problem by inventing the removable stressing head mounted on trolley wheels and rails. By rolling the stressing head to the open position the protruding ends of the stressing cables will clear the stressing block and the multi-stemmed concrete floor can be removed.

It is important to note that a pre-stressed multi-stemmed concrete floor system, that is manufactured in a self-stressing steel form as described above, is significantly compressed when the full force of the stressing strands is transferred to the fully cured concrete floor. This force will cause the multi-stemmed floor to bow up or form a camber in the center on the topside perpendicular to the stressing strands and to shrink on the bottom side parallel to the stressing strands. This will cause the inside face of the reinforced diaphragm headers to squeeze tightly against the inside flat surface of the diaphragm header forming trough 352. Due to the tremendous pressure exerted on this steel surface, the fully cured multi-stemmed concrete floor will bind against the steel casting form and could not be lifted or removed from the casting form. This is the reason that the double stemmed bridge slabs and other products currently manufactured by the pre-stressing method are open at the ends and are not closed with a reinforced diaphragm header.

This inventor has solved this problem by inventing a compressible filler assembly 410 that is placed on the inside flat surface of the diaphragm header forming trough 352 prior to pouring the concrete into the form. The compressible filler 412 allows the multi-stemmed floor to shrink on the bottom surface without binding against the steel casting form. This is a significant advancement in the art of pre-stressed concrete floor systems because, without a compressible filler separating the inside face of the reinforced diaphragm header from the inside flat surface of the diaphragm header forming trough, it would not be possible to manufacture the multi-stemmed concrete floor system described by the inventor.

The compressible filler is manufactured and assembled with an open cell foam core of less than an eight-pound per cubic foot density. The light density is necessary to allow the foam to compress with a minimal resistance to the concrete diaphragm header. The foam core is covered with a thin layer of aluminum or steel sheet metal 414 on the concrete side. The compressible filler is tapered from the top 416 to the bottom 418 with the narrow edge at the top and the wide edge at the bottom. This creates a hinge effect that allows the filler to compress more at the bottom where the greatest shrinkage or compression of the multi-stemmed concrete floor occurs. The sheet metal protects the compressible filler from the concrete and thereby enable the filler to be re-used for multiple castings and to form a smooth inner surface for the reinforced diaphragm header.

Lastly provided is at least one hi-pressure hydraulic cable jack (not shown) having a stressing cable recipient aperture there through. The cable jack may be any one of a plurality of commercially available cable jacks. The cable jack couples with the cable and introduces a predetermined amount of stress to that cable.

When in use, the removable stressing heads are rolled into the closed position, in which each of the stressing head/stressing block assemblies abuts the rear and front faces of the form table, forming the diaphragm header and longitudinal down turned stems. Each of the removable stressing heads abut an end of the form table at the contact surface 352, one at the front end, and one at the rear end of the form table. A stressing cable, or strand, is pulled through the stressing block, through the stressing head, through the form table and out through the opposite stressing head and stressing block. The cable protrudes from each stressing block. The cable lock-downs, or chucks, are then coupled to each of the stressing cables. The jacks are applied to the cables in a predetermined sequence and tension is introduced into the cable. The lock-downs or chucks are clamped to the cable when the desired tension is reached in the cable. The concrete is then poured into the self-stressing form table and allowed to harden.

When the concrete is hard, the cables or strands are then cut from between the stressing block and the form table. The removable stressing head is then rolled away from the form table to an open position. The completed multi-stemmed concrete floor is lifted vertically from the self-stressing form table.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A transportable multi-stemmed pre-stressed concrete floor system for manufactured buildings comprising, in combination:

a pair of multi-stemmed concrete floors with each multi-stemmed floor having a generally rectangular configuration with an up side and a down side and a thickness there between, each multi-stemmed floor having two parallel side edges and two parallel end edges, one end edge being the front end and one end edge being the rear end, with each multi-stemmed floor having a downwardly disposed short front diaphragm header and a parallel downwardly disposed rear diaphragm header and a plurality of long downwardly disposed stems there between, all stems of each multi-stemmed floor being perpendicular to the diaphragm headers and all stems having a pair of stressing cables running the length of the stems and through the front diaphragm header and through the rear diaphragm header, with two of the stems of each multi-stemmed floor being located on and contiguous with the side edges of the multi-stemmed floor and forming the edges of each multi-stemmed floor, the side edge of a multi-stemmed floor being configured to contact the side edge of another multi-stemmed floor to form a floor system, the stems of each multi-stemmed floor comprising inner stems and edge stems, the inner stems being between the two edge stems, the front inner stems each having a plurality of fifth wheel coupling bolt holes there through, the rear inner stems that are adjacent the side edge stems each have a plurality of suspension shackle mounting holes there through;

a wheel assembly having plurality of rigid metallic suspension shackle mounting plates with each having a squared U-shaped configuration with each plate receiving and snugly fitting the downwardly projecting stem of the multi-stemmed floor, each of the plates having a bolt hole there through with the bolt hole being alignable with the suspension shackle mounting bolt holes of the stems that are adjacent to the rear edge and side edge of the multi-stemmed floor, a wheel assembly being couple-able to the stems and having a plurality of axles with a plurality of wheels being rotatably coupled to each of the axles, with each axle being coupled to a pair of parallel suspension springs and each suspension spring being coupled to one of a pair of suspension carrying plates, the suspension carrying plate being coupled to a plurality of suspension shackle mounting plates, allowing the wheel assembly to be removably coupled to the multi-stemmed floor to allow the multi-stemmed floor to be trailed with a minimal road clearance sufficient to be used on all roadways without restriction;

a fifth wheel subassembly having a hitching portion for release-able attachment to a trailer hitch and an attachment portion for coupling with a multi-stemmed floor, the attachment portion having a plurality of rearward extending carrier beams, with each carrier beam having a plurality of rigid metallic suspension shackle mounting plates with each shackle mounting plate having a squared U-shaped configuration with each plate receiving and snugly fitting the downwardly projecting stem of the multi-stemmed floor, each of the mounting plates having a bolt hole there through with the bolt hole being align-able with the fifth wheel coupling bolt holes of the front inner stems of the multi-stemmed floor, allowing the fifth wheel subassembly to be removably coupled to the multi-stemmed floor to allow the floor to be trailed with a minimal road clearance sufficient to be used on all roadways without restriction; and a plurality of bolts to couple the multi-stemmed floor to the wheel assembly and the fifth wheel subassembly, thereby allowing the multi-stemmed floor to be pulled from one location to another with ease and safely.

2. A transportable pre-stressed concrete floor system comprising:

a pair of multi-stemmed concrete floors each having inner stems and edge stems with the inner stems being located between the edge stems;

a front diaphragm header and a parallel rear diaphragm header with the headers being perpendicular to and containing a plurality of downwardly disposed stems, the stems of each concrete floor comprising a plurality of inner stems and two edge stems with the stems each having a front and rear portion, with the inner stems being parallel with the edge stems, front inner stems each having a plurality of fifth wheel coupling bolt holes there through, rear inner stems each have a plurality of suspension shackle mounting holes there through;

a wheel assembly having a plurality of rigid metallic suspension shackle mounting plates for removably coupling with the stems of the slab;

a fifth wheel subassembly having a tractor attachment portion and a stem attachment portion, the stem attachment portion having a plurality of rigid metallic suspension shackle mounting plates for removable coupling with the stems of the multi-stemmed floor;

a plurality of bolts to couple the stems of the multi-stemmed concrete floor system to the wheel subassembly and the fifth wheel subassembly.

3. The system as set forth in claim 2 wherein the fifth-wheel subassembly is rectangular in shape with a coupler, the coupler having a L-shaped base for a releasable coupling to the multi-stemmed concrete floor, the coupler also having an apex with a downwardly extending kingpin for releasable coupling of the multi-stemmed concrete floor to a vehicle to thereby facilitate transportation.

4. A transportable pre-stressed concrete floor system comprising;

a pair of multi-stemmed concrete floors each having a front diaphragm header and a rear diaphragm header and a plurality of downwardly disposed parallel inner stems and edge stems there between with each stem having a front portion and a rear portion and being oriented perpendicular to the front and rear diaphragm headers with the parallel edge stems extending perpendicular to and between the front and rear diaphragm headers with the edge stems being longer than the headers and the inner stems being parallel with the edge stems and located between the diaphragm headers wherein the system further comprises a wheel assembly for removably coupling with the stems, the system further comprises a fifth wheel subassembly having a tractor attachment portion and a slab attachment portion for removable coupling with the stems of the multi-stemmed floor, a jacking subassembly having a support plate positioned between the stems adjacent to the rear of the edge stem with squared U-shaped regions for encompassing the stems, with attachment apertures formed in the stems and projections for a releasable connection there between.

* * * * *